US012042044B2

(12) United States Patent
Honermann et al.

(10) Patent No.: US 12,042,044 B2
(45) Date of Patent: Jul. 23, 2024

(54) ASSEMBLY FOR SECURING FIREARMS

(71) Applicant: Quality Wood Designs Inc., Mitchell, SD (US)

(72) Inventors: Michael Honermann, Mitchell, SD (US); Nicholas Novak, Mitchell, SD (US)

(73) Assignee: Quality Wood Designs Inc., Mitchell, SD (US)

( * ) Notice: Subject to any disclaimer, the term of this patent is extended or adjusted under 35 U.S.C. 154(b) by 0 days.

(21) Appl. No.: 18/148,497

(22) Filed: Dec. 30, 2022

(65) Prior Publication Data

US 2023/0218081 A1 Jul. 13, 2023

Related U.S. Application Data

(60) Provisional application No. 63/336,029, filed on Apr. 28, 2022, provisional application No. 63/299,235, filed on Jan. 13, 2022.

(51) Int. Cl.
*A47B 81/00* (2006.01)
*F41A 23/18* (2006.01)

(52) U.S. Cl.
CPC ..... *A47B 81/005* (2013.01); *F41A 23/18* (2013.01)

(58) Field of Classification Search
CPC ..... A47B 81/005; F41A 23/18
See application file for complete search history.

(56) References Cited

U.S. PATENT DOCUMENTS

| | | | |
|---|---|---|---|
| 2,857,233 | A | 10/1958 | Reiss et al. |
| 2,958,422 | A | 11/1960 | Caloiero et al. |
| 3,038,774 | A | 6/1962 | Cyrus |
| 3,664,163 | A | 5/1972 | Foote |
| 3,927,923 | A | 12/1975 | Kimmel |
| 4,204,601 | A | 5/1980 | Thomas |
| 4,289,290 | A | 9/1981 | Miller |
| 4,335,872 | A | 6/1982 | Caplis et al. |
| 4,461,385 | A | 6/1984 | Clouser |
| 4,555,147 | A | 11/1985 | Jackson |
| 4,741,628 | A | 5/1988 | Kinley |
| 5,022,536 | A | 6/1991 | Pierson |
| 5,025,545 | A | 6/1991 | Brown |
| 5,048,212 | A | 9/1991 | Mossberg |

(Continued)

FOREIGN PATENT DOCUMENTS

| | | |
|---|---|---|
| DE | 19537739 | 4/1997 |
| GB | 2445210 | 3/2011 |

(Continued)

*Primary Examiner* — Nirvana Deonauth
(74) *Attorney, Agent, or Firm* — Mai D. Lauer; Westman, Champlin & Koehler P.A.

(57) ABSTRACT

An assembly, including a cable and a bracket, is configured to secure a firearm having a shell ejection slot. The bracket, including a front plate and a tail, is configured for partial insertion into the shell ejection slot. The tail is disposed at an acute angle relative to the front plate and comprises a first aperture configured for insertion of the cable. A method of securing a firearm includes inserting a tail of a bracket into the shell ejection slot so that a front plate of the bracket remains outside the shell ejection slot, inserting a first end of a cable through a first aperture of the tail, and retaining the first end of the cable in a notch of a firearm holder.

20 Claims, 18 Drawing Sheets

(56) References Cited

U.S. PATENT DOCUMENTS

| | | | | |
|---|---|---|---|---|
| 5,325,686 | A | 7/1994 | Bentley | |
| 5,524,772 | A * | 6/1996 | Simmons | A47B 81/005 211/4 |
| 5,615,936 | A | 4/1997 | Simmons et al. | |
| 5,934,112 | A | 8/1999 | Rice et al. | |
| 6,052,934 | A | 4/2000 | Carpenter | |
| 6,256,920 | B1 | 7/2001 | Olson | |
| 6,497,185 | B1 | 12/2002 | Barrett et al. | |
| 6,804,906 | B1 * | 10/2004 | Olsen | F41A 17/44 42/70.11 |
| 6,863,185 | B2 | 3/2005 | Mele et al. | |
| 7,178,889 | B2 | 2/2007 | Hoshide et al. | |
| 7,478,892 | B2 | 1/2009 | Punzel et al. | |
| 7,731,310 | B2 | 6/2010 | Kohlmann et al. | |
| 8,733,865 | B1 | 5/2014 | Chambers et al. | |
| 9,198,512 | B1 | 12/2015 | Moayeri | |
| 10,072,904 | B2 | 9/2018 | Binns | |
| 2004/0164036 | A1 | 8/2004 | Cummins | |
| 2006/0283820 | A1 | 12/2006 | Peters et al. | |
| 2007/0024165 | A1 | 2/2007 | Moulton | |
| 2012/0152767 | A1 | 6/2012 | Harry | |
| 2022/0268544 | A1 * | 8/2022 | Palovaara | F41A 17/44 |

FOREIGN PATENT DOCUMENTS

| | | |
|---|---|---|
| WO | 2020117697 | 6/2020 |
| WO | 2021005262 | 1/2021 |

* cited by examiner

ASSEMBLY FOR SECURING FIREARMS

CROSS REFERENCE TO RELATED APPLICATIONS

This application claims the benefit of priority of Provisional U.S. Patent Application 63/299,235 filed Jan. 13, 2022 for "Cable Assembly for Securing Firearms." This application also claims the benefit of priority of Provisional U.S. Patent Application 63/336,029 filed Apr. 28, 2022 for "Handgun Display Assembly with Locking Apparatus." The contents of these priority applications are hereby incorporated by reference in their entireties.

BACKGROUND

For promoting sales of firearms, retailers often wish to display their inventory for easy perusal by customers. However, the displayed firearms should also be secured against unauthorized handling. A conventional secure storage unit for firearms, such as a gun safe, often has a disadvantage of hiding the secured firearms from view, thereby requiring the time and attention of a sales person in order to even allow a customer to visually inspect the merchandise. Other displays that do not visually obscure the merchandise may not provide a high level of security. For example, locks may be used to secure the cabinet doors of display cabinets. However, breaking a single lock on a display cabinet door could allow a thief to access all of the firearms housed in the cabinet.

SUMMARY

In one aspect, an assembly is configured to secure a firearm having a shell ejection slot. In an exemplary embodiment, the assembly comprises a cable and a bracket. The bracket is configured for partial insertion into the shell ejection slot. The bracket comprises a front plate and a tail. The tail is disposed at an acute angle relative to the front plate and comprises a first aperture configured for insertion of the cable.

In another aspect, a method of securing a firearm having a shell ejection slot is described. The method comprises inserting a tail of a bracket into the shell ejection slot so that a front plate of the bracket remains outside the shell ejection slot, inserting a first end of a cable through a first aperture of the tail, and retaining the first end of the cable in a notch of a firearm holder.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. All descriptions are applicable to like and analogous structures throughout the several embodiments, unless otherwise specified.

FIG. 10 shows the stock holder with a first jaw closed over a second jaw thereof, to lock the first end of the cable in the stock holder notch.

Figure 1:
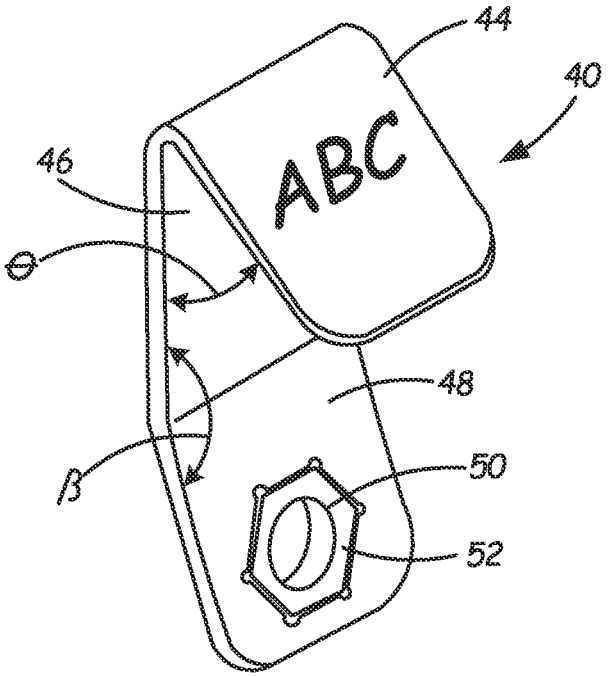
FIG. 1 is a perspective view of a securing bracket configured for insertion into the shell ejection slot and magazine well of a firearm.

While the above-identified figures set forth multiple embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

The same or similar reference numerals are used in different figures for the same or similar elements. All descriptions of an element also apply to all other versions of that element unless otherwise stated. The terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps and do not supply a serial or numerical limitation on the elements or steps of the embodiments thereof. For example, "first," "second," and "third" elements or steps need not necessarily appear in that order, and the embodiments thereof need not necessarily be limited to three elements or steps. Unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. The singular forms of "a," "an," and "the" include plural references unless the context clearly dictates otherwise.

DETAILED DESCRIPTION

Figure 2:
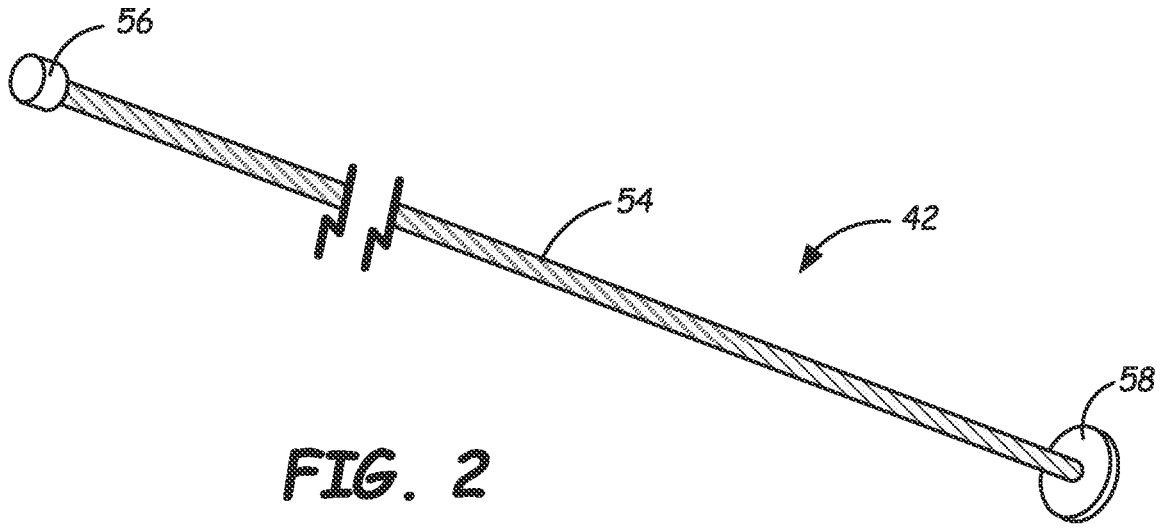
FIG. 2 is a perspective view of a cable configured for use with the bracket of FIG. 1.
Figure 3:
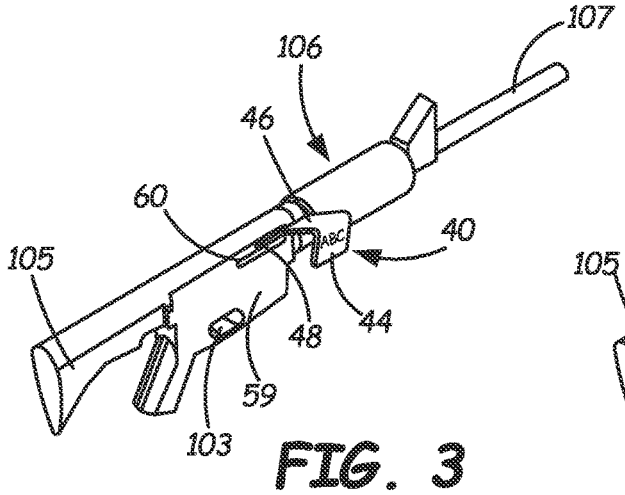
FIG. 3 is a perspective view of a firearm with the securing bracket being inserted into its shell ejection slot.
Figure 4:
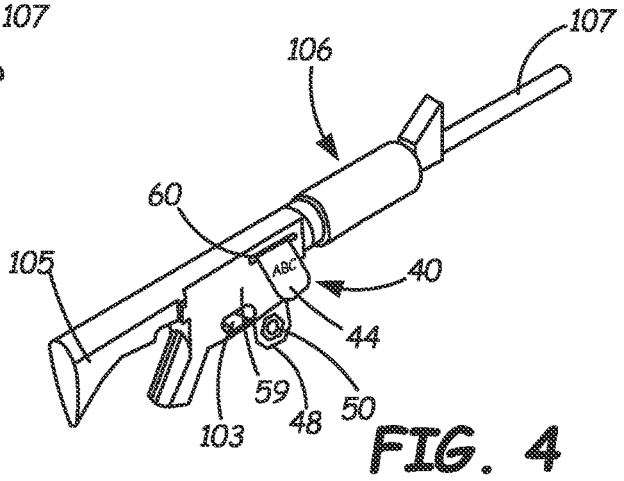
FIG. 4 is similar to FIG. 3 but shows full insertion of the securing bracket into the firearm, through its shell ejection slot and into and through its magazine well.
Figure 5:
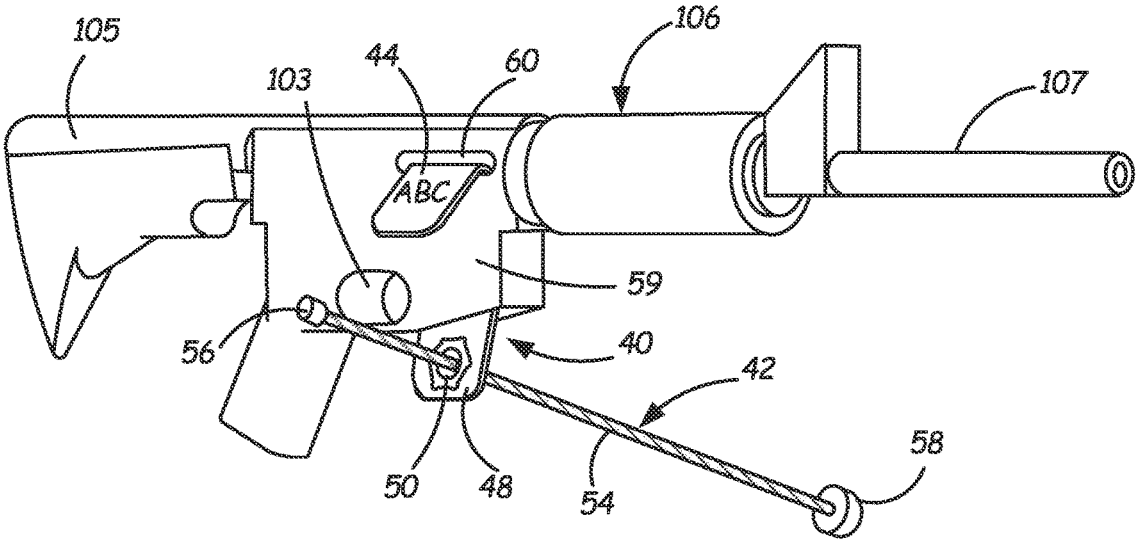
FIG. 5 is a perspective view of the firearm with one end of the cable inserted into an aperture of the securing bracket.

This disclosure relates to a cable assembly for securing firearms, an exemplary assembly including securing bracket 40 of FIG. 1 and cable 42 of FIG. 2. In an exemplary embodiment, securing bracket 40 is made of a bent plate, wherein first section 44 is bent at an acute angle θ relative to middle or second section 46. In an exemplary embodiment, securing bracket 40 is made of hardened steel so that after formation, it is resistant to bending, cutting, and other deformation. Third section 48 is bent at an obtuse angle β relative to the second or middle section 46. As shown in FIGS. 3-5, the securing bracket 40 is configured with an overall length and width so that the middle and third sections 46, 48 may be inserted into the magazine well 59 of a firearm 106, while the first section 44 remains outside of a shell ejection slot 60 of the firearm 106. As such, particular dimensions of securing bracket 40 can vary, dependent upon the firearm on which it is designed to be used, though suitable dimensions include a width of up to about two inches and a length (vertically) as shown in FIG. 1 of about 5 inches. The acute angle θ is small enough that the first section 44 is prevented from following the second section 46 into the magazine well 59 of the firearm 106. The third section 48 includes an aperture 50 therethrough defined by a hardened steel nut 52 welded into the third section 48, and is long enough that the aperture 50 is readily accessible below a bottom of the magazine well 59.

FIG. 2 is a perspective view of a cable 42 configured for use with the securing bracket 40. In an exemplary embodiment, cable 42 includes a multi-strand uncoated wire cord 54 that is resistant to cutting by standard tools. Cable 42 has a small end 56 and a large end 58. A suitable uncoated cable made of hot-dipped galvanized metal and having ¼" diameter is commercially available from Rigging Warehouse Company of Saugerties, NY (on the internet at riggingwarehouse.com) under model name/number 106-GAC9/250-1000 Uncoated Galvanized Air Craft Cable ¼"×1000' 7×19 (7 strands and 19 wires per strand for high flexibility). In an exemplary embodiment, cable 42 has a breaking strength of about 7,000 pounds and a working load limit of about 1,400 pounds. An exemplary cable 42 weighs about 0.11 pound per foot of length and adheres to federal specification RR-W-410H. Cable 42 can be of any length, as suitable to provide structure to perform the described functions.

In an exemplary embodiment, small end 56 has a hardened steel stud that has a smaller diameter than aperture 50 of securing bracket 40. Large end 58 in an exemplary embodiment has a hardened steel disk with a larger diameter than aperture 50. A suitable nut for large end 58 is made of 2H hardened steel or a laser cut part of similar material and having ⅝" diameter. An exemplary part is commercially available from Fastenal Company of Winona, MN under model name/number 0169703⅝"-11 ASTM A194 Grade 2H Plain Finish Steel Jam Nut Heavy.

FIGS. 3 and 4 show insertion of securing bracket 40, with the leading end for insertion being third section 48, into the shell ejection slot 60 of a firearm 106. The illustrated firearm has stock 105 and muzzle 107. As shown in FIG. 4, because of the acute angle θ between first section 44 and middle section 46, the first section 44 remains outside of the shell ejection slot 60 while the middle section 46 is inside the firearm 106 and the third section 48 hangs below the magazine well 59 of the firearm 106. Moreover, the acute angle θ positions a front surface of the first section 44 outward and forward, toward a viewer, to offer a prominent location for display of a company logo or other visual indicia. In an exemplary embodiment, angle θ is 50 degrees, and a range from about 45 degrees to about 55 degrees is suitable. The obtuse angle β allows for insertion of securing bracket 40 into a shell ejection slot 60 located on a side wall of the magazine well 59, allowing the securing bracket 40 to maneuver through the limited depth space of magazine well 59. Additionally, the obtuse angle β between the middle section 46 and the third section 48 brings the third section forward toward a user for easy access to aperture 50 which is disposed below a bottom of magazine well 59 (on a right side of the firearm 106). In an exemplary embodiment, angle β is 160 degrees, and a range from about 155 degrees to about 165 degrees is suitable.

FIG. 5 shows insertion of small end 56 of cable 42 through aperture 50. The cable assembly is configured so that large end 58 is too large to pass through aperture 50. With cable 42 inserted into aperture 50 of securing bracket 40, the securing bracket 40 cannot be withdrawn from the shell ejection slot 60 and magazine well of firearm 106.

The cable assembly of FIGS. 1-5 is designed for use in securing firearms 106 to various firearm display holders 300, such as those described below. In some respects, the different illustrated and exemplary embodiments of firearm holders 300 are similar. Five embodiments of firearm holders 300*a*, 300*b*, 300*c*, 300*d* and 300*e* are described. When referring to the firearm holders in general, they may be referred to as firearm holder(s) 300. Suitable firearms 106 for use with the described firearm holders 300 include automatic rifles, semi-automatic rifles, shot guns, and handguns such as a pistol, an airsoft gun, a pellet gun, a BB gun (e.g., a steel ball gun), or a paintball gun, for example. For a firearm holder 300 configured to hold four firearms 106, cable 42 may have a length of about 26 inches to about 32 inches, for example. For a firearm holder 300 configured to hold five firearms 106, cable 42 may have a length of about 28 inches to about 34 inches, for example. Descriptions for similarly numbered parts also apply to all other such similarly numbered parts of different embodiments unless stated otherwise.

FIGS. 6-11 illustrate the use of the described cable assembly with a firearm holder 300*a*. The firearm holder 300*a* includes stock holder 120 and muzzle holder 104 to support firearms 106 having stocks 105 and muzzles or barrels 107. In an exemplary embodiment, stock holder 120 has a first jaw 123 and a second jaw 124 pivotally coupled at a pivot pin 132. In an exemplary embodiment, lock 102 is disposed on first jaw 123 and is configured as a plunger lock including a plunger pin 142 (labeled in FIGS. 18A-19B; the same type of lock 102 is used in a different configuration of a firearm holder 300*c*) configured for releasable insertion into aperture 98 of second jaw 124 (by extension and retraction of the plunger pin 142). When lock 102 is actuated (locked), the first jaw 123 is fixed to the second jaw 124 in a closed state (shown in FIGS. 6, 7, 10 and 11) to secure the firearms 106 by their stocks 105. In some implementations, the first jaw 123 and the second jaw 124 define an enclosure 126 sized to receive a narrow portion or neck of the stock 105 of the firearm 106. In an exemplary embodiment, the enclosure 126 is too narrow to allow the stock 105 of the firearm 106 to slide out of the stock holder 120 (in either a left or right direction) when locked closed.

Figure 8:
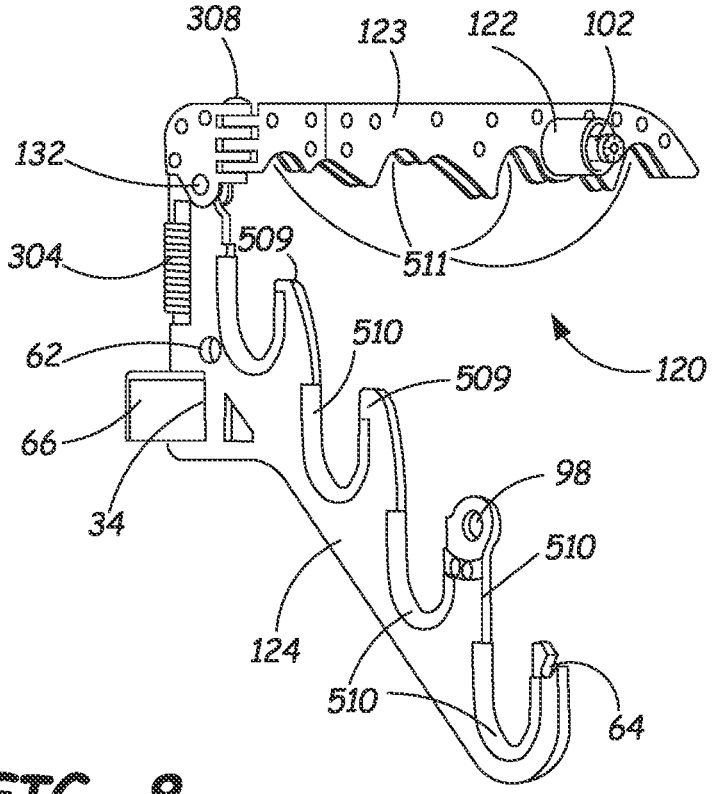
FIG. 8 is a perspective view of the stock holder with the first jaw opened and pivoted away from the second jaw.

As shown in FIG. 8, in an exemplary embodiment, second jaw 124 includes a plurality of recesses 510, each of which is configured to receive a neck of a stock 105 of a firearm 106. The term "neck" refers to a portion of the stock 105 that is narrower than the end of the stock 105 that is farthest from the muzzle 107. In an exemplary embodiment, first jaw 123 includes corresponding recesses 511, each of which is configured to fit around a neck of a stock 105 of a firearm 106. In an exemplary embodiment, each of the recessed areas 510 and 511 is paired or aligned to form an enclosure 126 sized to receive the "neck" portion of a stock 105 of a firearm 106. The enclosures 126 are approximately equal in size, where each enclosure 126 in an exemplary embodiment has a height of approximately 3 and 9/16 inches and a width of approximately 2 and 1/8 inches. In an exemplary embodiment, when stock holder 120 is closed, first jaw 123 overlaps the second jaw 124 at each ridge 509. The overlap removes potential pry points that might otherwise be used by an unauthorized party (e.g., a child, thief, etc.) to open the locked stock holder 120.

Figure 9:
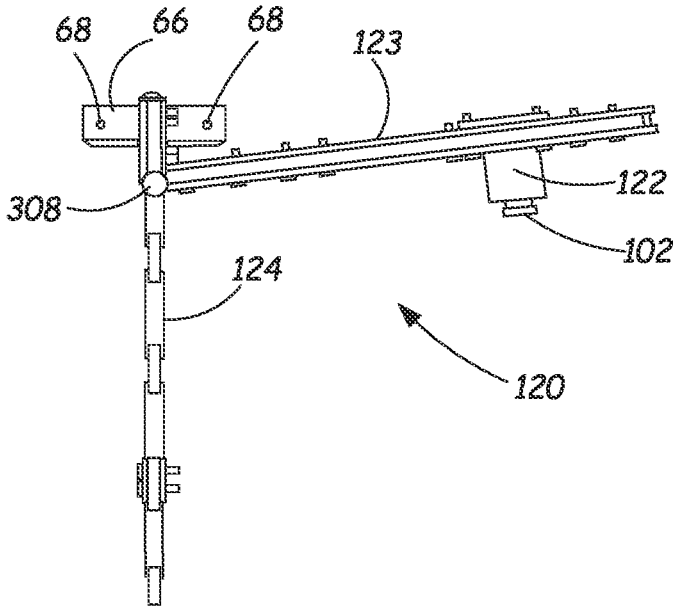
FIG. 9 is a top view of the stock holder of FIG. 8.

FIGS. 8 and 9 show stock holder 120 in an open state, to allow for insertion and removal of stocks 105 of firearms 106. Lock 102 is unlocked and open, allowing access to each of the firearms 106. In some embodiments, biasing element 304 is connected between the first jaw 123 and the second jaw 124 to bias the first jaw 123 into an open position relative to the second jaw 124. When the lock 102 is disengaged, biasing element 304 retracts, thereby pulling the first jaw 123 into a lifted position relative to the second jaw 124 about the pivot pin 132. When the lock 102 is in a closed state, the biasing element 304 is in tension. When the lock 102 is unlocked and the lock's plunger pin 142 is withdrawn from the aperture 98 of second jaw 124, the biasing element 304 contracts to urge the first jaw 123 to pivot about the pivot pin 132, relative to the second jaw 124. In an alternative embodiment, the aperture 98 may be formed in the first jaw 123, and the lock 102 and its plunger 142 may be coupled to the second jaw 124.

In an exemplary embodiment, biasing element 304 is a helical tension spring. In an exemplary embodiment, as shown in FIGS. 8 and 9, the first jaw 123 may also be configured to rotate or pivot about a swivel assembly 308 (such as a pin hinge, for example) in a second direction away from and toward second jaw 124. In some embodiments, the pivot devices 132, 308 may be rivet, a fastener, a rod, a pin or other type of swivel assembly configured to define a pivot axis about which the first jaw 123 may rotate to facilitate opening and closing of the first jaw 123 relative to the second jaw 124. Pivot limiters may be provided to limit the extent of pivoting of first jaw 123 relative to second jaw 124.

Figure 11:
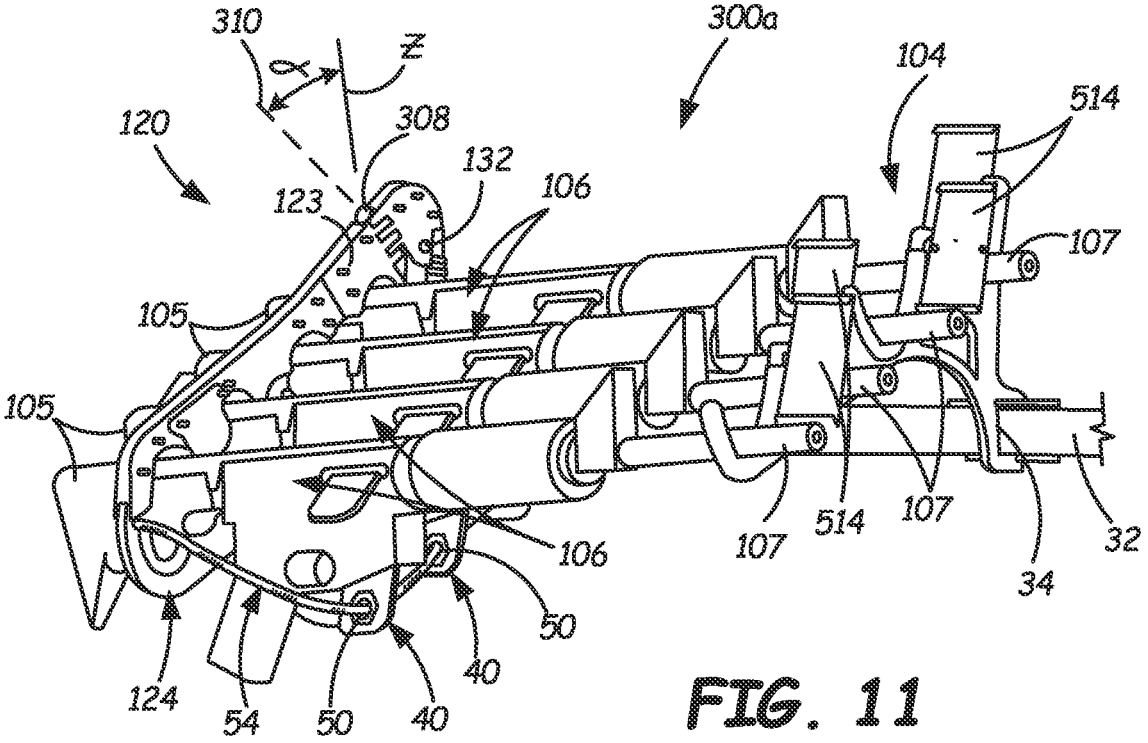
FIG. 11 is a perspective view of the firearm holder showing three additional firearms and corresponding muzzle holders.

FIGS. 8 and 9 depict the stock holder 120 in an unlocked, open, and swiveled state. Moving the upper jaw 123 out of the space above the lower jaw 124 allows for ease of access to lower jaw 124, so that a selected individual firearm 106 can be easily inserted into a recess 510 in lower jaw 124 or lifted upward for removal from the lower jaw 124. In an exemplary embodiment, swivel assembly 308 is a pin hinge disposed on first jaw 123 between pivot pin 132 and lock 102. As shown in FIG. 11, in an exemplary embodiment, a pivot axis 310 of swivel assembly 308 is inclined at angle alpha (α) to a vertical Z axis.

Figure 6:
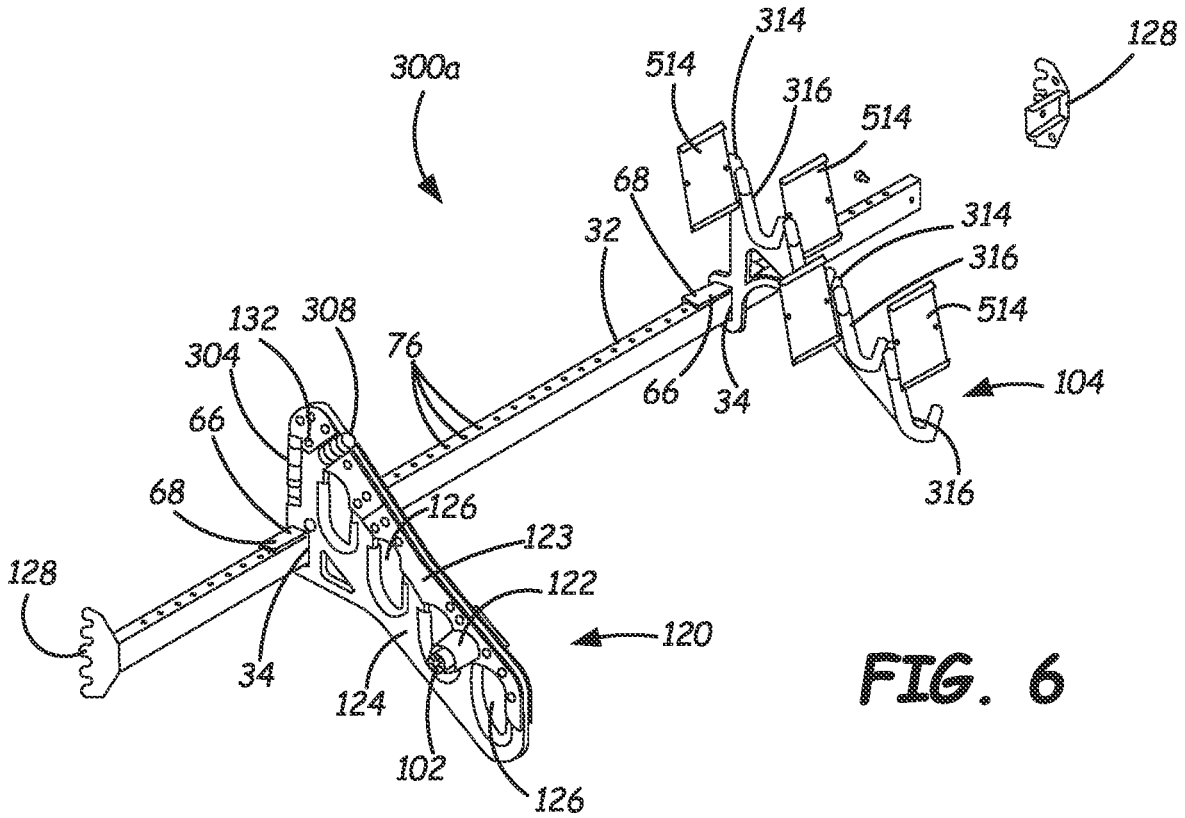
FIG. 6 is a perspective view of components of a first embodiment of a firearm holder for use with the described cable assembly.
Figure 7:
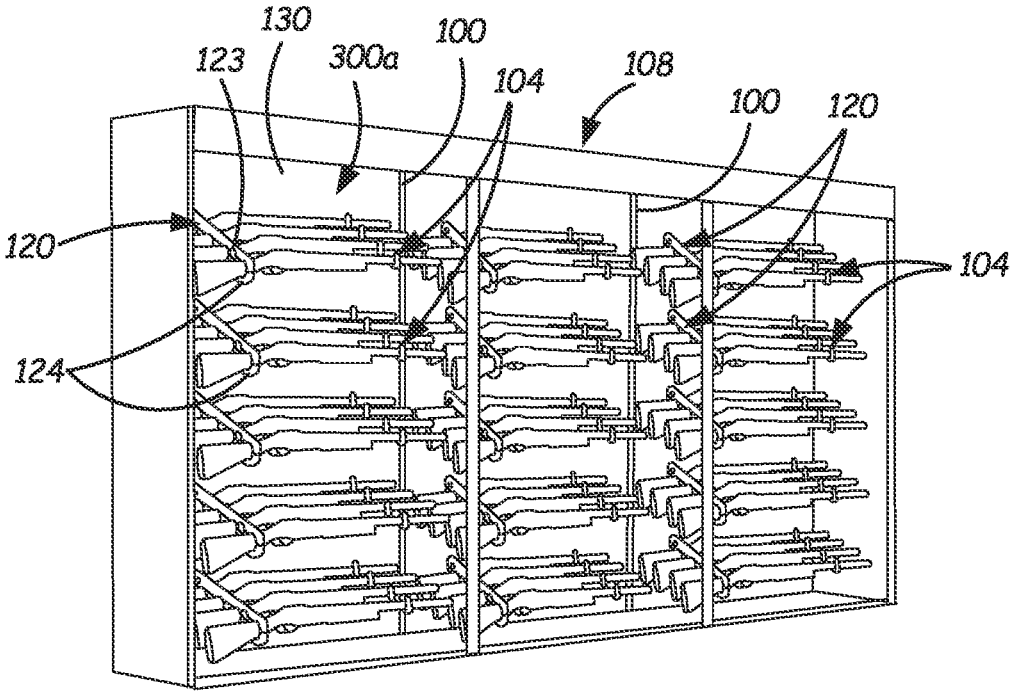
FIG. 7 is a perspective view of a cabinet holding several such firearms holders, showing horizontally oriented firearms.

In an exemplary embodiment, as shown in FIGS. 6, 7 and 11, muzzle holder 104 is configured to support the muzzles 107 of firearms 106. In an exemplary embodiment, muzzle holder 104 includes contact pads on cradles 316 to prevent scratching of the muzzles 107 of the firearms 106. The contact pads may include a surface coating, such as rubber, fabric, or other protective covering materials or substances. In an exemplary embodiment, muzzle holder 104 includes a plurality of ridges 314 separated by muzzle-receiving cradles 316. Each muzzle-receiving cradle 316 is configured to receive and support a muzzle 107 of a firearm 106. In an exemplary embodiment, each depression or muzzle-receiving cradle 316 corresponds with a tag holder 514. In an exemplary embodiment, a tag holder 514 extends from each ridge 314 between adjacent cradles 316, and is configured to bear informational indicia thereon, such as a printed card with model and price information for the firearm held within the respective cradle 316. In some embodiments, tag holder 514 can have a similar structure as flange 66 of firearm holder 300*c*, with bottom and top lips to hold a card or other label.

As illustrated, each muzzle-receiving cradle 316 is configured as an open recess or notch. Alternatively, each muzzle-receiving cradle 316 could be configured as a hole with a closed perimeter to offer more secure support of muzzle 107, in which longitudinal sliding of the firearm is used to release its muzzle 107 from the closed cradle 316 (as in firearm holder 300*e*, shown in FIGS. 27 and 28). All parts of firearm holders 300 that contact firearm 106 may be lined, coated or covered (such as with rubber or fabric) to prevent scratches; such parts include cradle 316 and recesses 510 for example.

In some exemplary embodiments, each stock holder 120 and muzzle holder 104 includes an opening 34 sized to receive rail 32. In an exemplary embodiment, opening 34 has a height of 1 and 9/16 inches and a width of 13/16 inches. In an exemplary embodiment, rail 32 extends through stock holder 120 and muzzle holder 104 and allows for slidable, adjustable spacing between the stock holder 120 and muzzle holder 104. In the illustrated examples, the rail opening 34 has a substantially rectangular shape, which matches the profile of the rail 32 and which prevents rotation of the mounted firearm holder components. In an exemplary embodiment, rail 32 is a bar, rod, beam, or other rigid elongated element made of steel, carbon fiber, another metal or material or any combination thereof.

Figure 10:
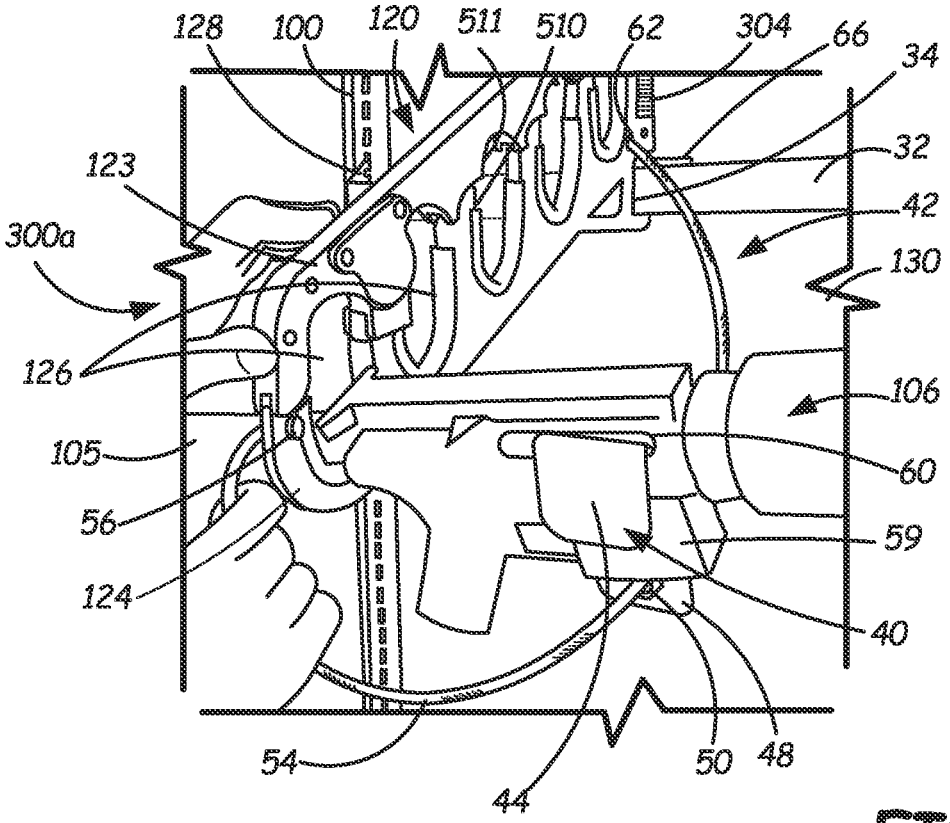
FIG. 10 is a perspective view of the stock holder with the first end of the cable inserted through an aperture of a stock holder on which a stock of a firearm is mounted.

In an exemplary embodiment, rail 32 is secured to a structure, such as a vertical support 100 or wall 130 of cabinet 108 (labeled in FIG. 7) by mounting brackets 128 at each end of rail 32 (labeled in FIGS. 6 and 10). The mounting brackets 128 may include a hook, a z-clip, teeth, or other feature configured to engage a support structure, such as a support 100, wall 130, cabinet 108, a safe housing, or another structure. In some implementations, the rail 32 and/or mounting bracket 128 may be fastened to the support structure using screws, nails, or other fasteners.

In an exemplary embodiment, downwardly sloping stock holder 120 and muzzle holder 104 define an acute inclination angle (that is the complement of angle alpha ($\alpha$) labeled in FIG. 11), that is approximately 40-60 degrees relative to a vertical axis Z. This configuration allows for ease of viewing all firearms 106, though some are positioned behind others, such as shown in FIGS. 7 and 11. Moreover, a steeper inclination of the stock holder 120 and muzzle holder 104 allows for higher capacity of support of firearms 106 in a set depth of a space such as cabinet 108. In an exemplary embodiment, stock holder 120 has a height of about 10 and 13/16 inches. The depth that stock holder 120 extends from the supporting structure (such as a wall 130 or back of cabinet 108) is approximately 13 and 1/8 inches in an exemplary embodiment.

In this example, the second jaw 124 is configured to secure the stocks 105 of four different firearms 106; however, the size of the second jaw 124 (and the corresponding size of the muzzle holder 104) may be changed to secure more or fewer firearms 106 depending on the depth of the structure (e.g., cabinet 108) configured to house the firearms 106. Other design considerations, such as weight of the stock holder 120, the weight of the firearms 106, and so on may also influence the size of the stock holder 120 and the number of firearms 106 that the stock holder 120 is designed to support.

FIG. 10 shows a firearm 106 with its stock 105 supported on one of the recesses 510 of lower jaw 124 and in enclosure 126. Securing bracket 40 has been inserted into the shell ejection slot 60 and magazine well 59 of the firearm 106. Small end 56 of cable 42 has been passed through aperture 62 of stock holder 120. In an exemplary embodiment, aperture 62 may be dimensioned similarly to aperture 50 of securing bracket 40, to thereby allow passage of small end 56 of cable 42 but restrict passage of large end 58 therethrough.

Figure 13:
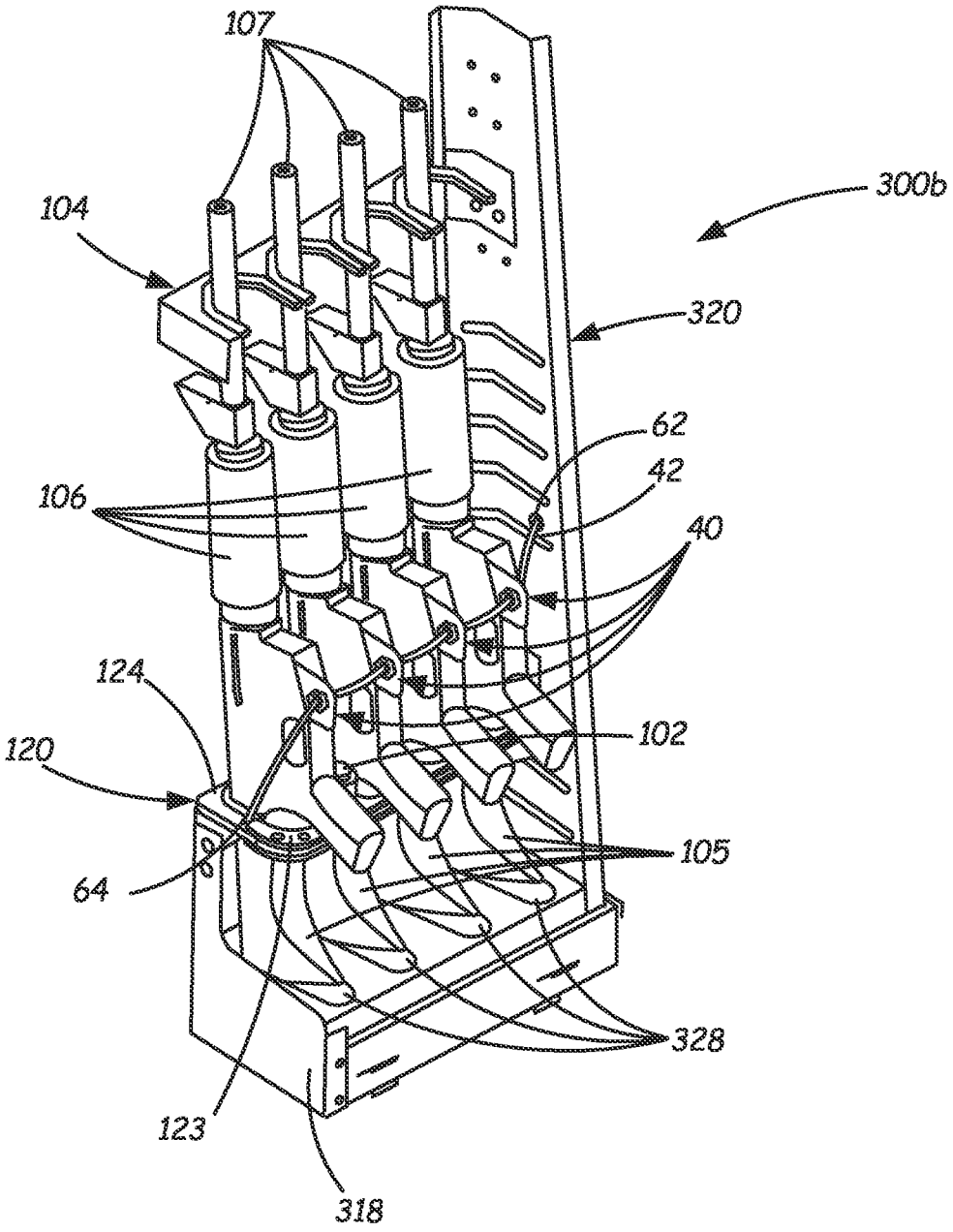
FIG. 13 is a perspective view of the second exemplary embodiment of a firearm holder, with vertically oriented firearms therein, and with the stock holder in a closed configuration.

The user then passes small end 56 of cable 42 through aperture 50 of the tail 46, 48 of securing bracket 40. The small end 56 is then moved past notch 64 (labeled in FIG. 8) of lower jaw 124 of stock holder 120. Notch 64 is sized to allow insertion of cord 54 but not allow small end 56 to pull through the notch 64. As shown in FIG. 10, when first jaw 123 is lowered onto and locked into position over second jaw 124, cable 42 cannot be removed laterally from notch 64, and the combination of the notch 64 size and first jaw 123 form a locking enclosure smaller than the small end 56 of cable 42. Thus, as shown in FIG. 10, the cable assembly of securing bracket 40 and cable 42, used with firearm holder 300*a*, redundantly locks the firearm 106 to the firearm holder 300*a* in a visually unobtrusive manner to provide security while allowing full view of the firearm 106. As shown in FIGS. 11 and 13, cord 54 of a single cable 42 may be inserted through multiple brackets 40.

FIG. 6 shows that the stock holder 120 and muzzle holder 104 can be adjustably placed on rail 32, by sliding along the rail 32 to achieve a desired distance between the stock holder 120 and muzzle holder 104, to accommodate different lengths of firearms 106. If a user wishes to maintain the relative spacing and positions of stock holder 120 and muzzle holder 104 on rail 32, each of these components has a locking flange 66 provided proximate rail opening 34. As shown in FIGS. 6 and 9, each locking flange 66 has an aperture 68 configured to align with any of a plurality of cooperating apertures 76 in rail 32. Thus, after a user has slid each of stock holder 120 and muzzle holder 104 to a desired position on rail 32, the user can insert a fastener such as a screw into the aligned apertures 68 and 76 to fix the respective stock holder 120 or muzzle holder 104 to the rail 32 in the desired positions.

As illustrated in FIGS. 7, 10 and 11, the stock holders 120 and muzzle holders 104 of firearm holder 300*a* are shown as securing one or more firearms 106 horizontally. However, in other embodiments, such as shown in FIGS. 12-14 and 25-28, the stock holders 120 and muzzle holders 104 of firearm holders 300*b*, 300*d* and 300*e* are configured to secure the plurality of firearms 106 substantially vertically. Firearm holders 300 can also be configured to support firearms 106 at another orientation. In many of the illustrated examples, each set of stock holder 120 and muzzle holder 104 is designed to support up to four firearms 106, locking their respective stocks 105 between the first jaw 123 and the second jaw 124. However, a firearm holder 300 may be configured to support more or fewer firearms.

Figure 12:
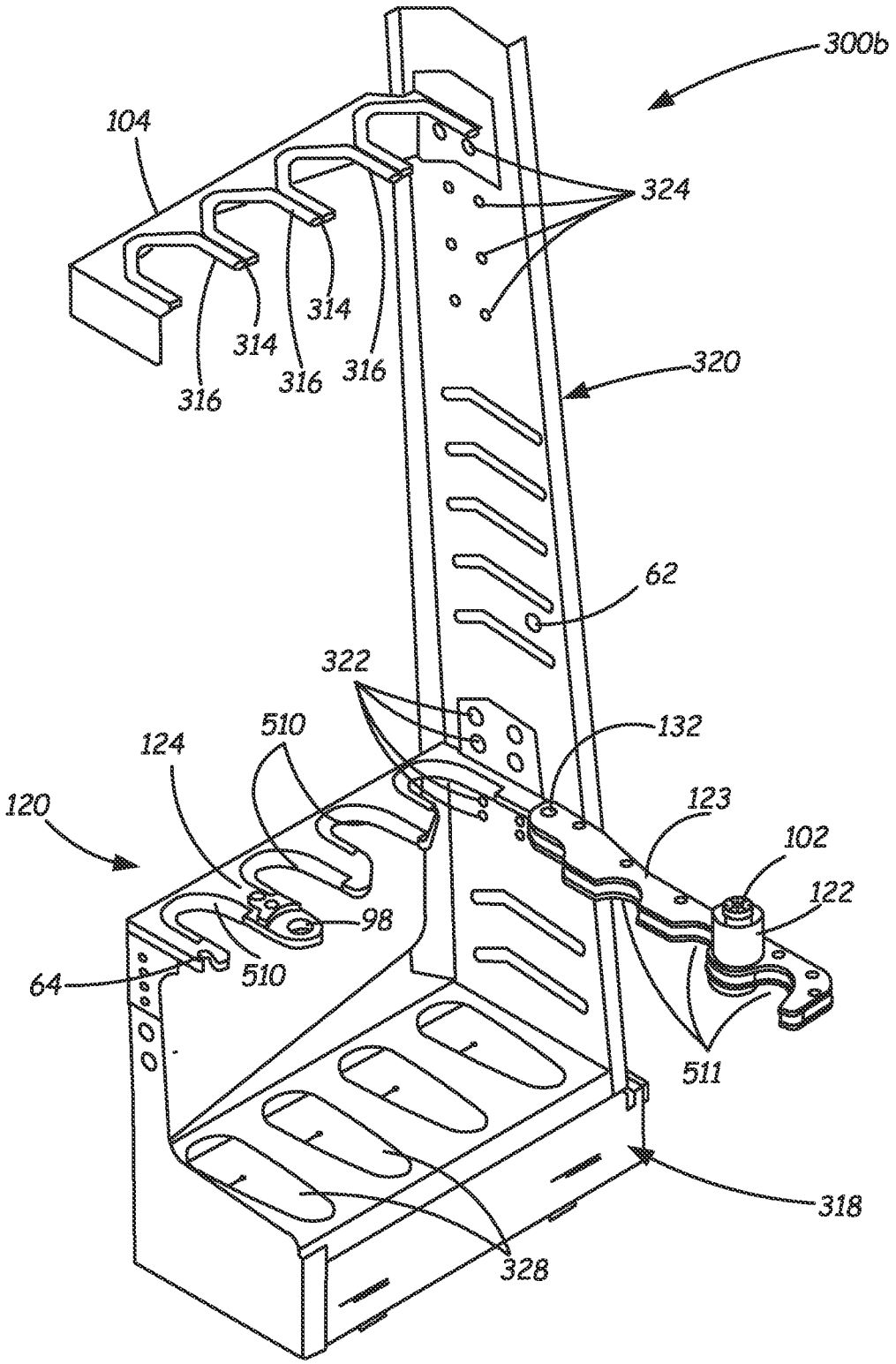
FIG. 12 is a perspective view of a second exemplary embodiment of a firearm holder, for vertically oriented firearms, with the stock holder in an open configuration.
Figure 14:
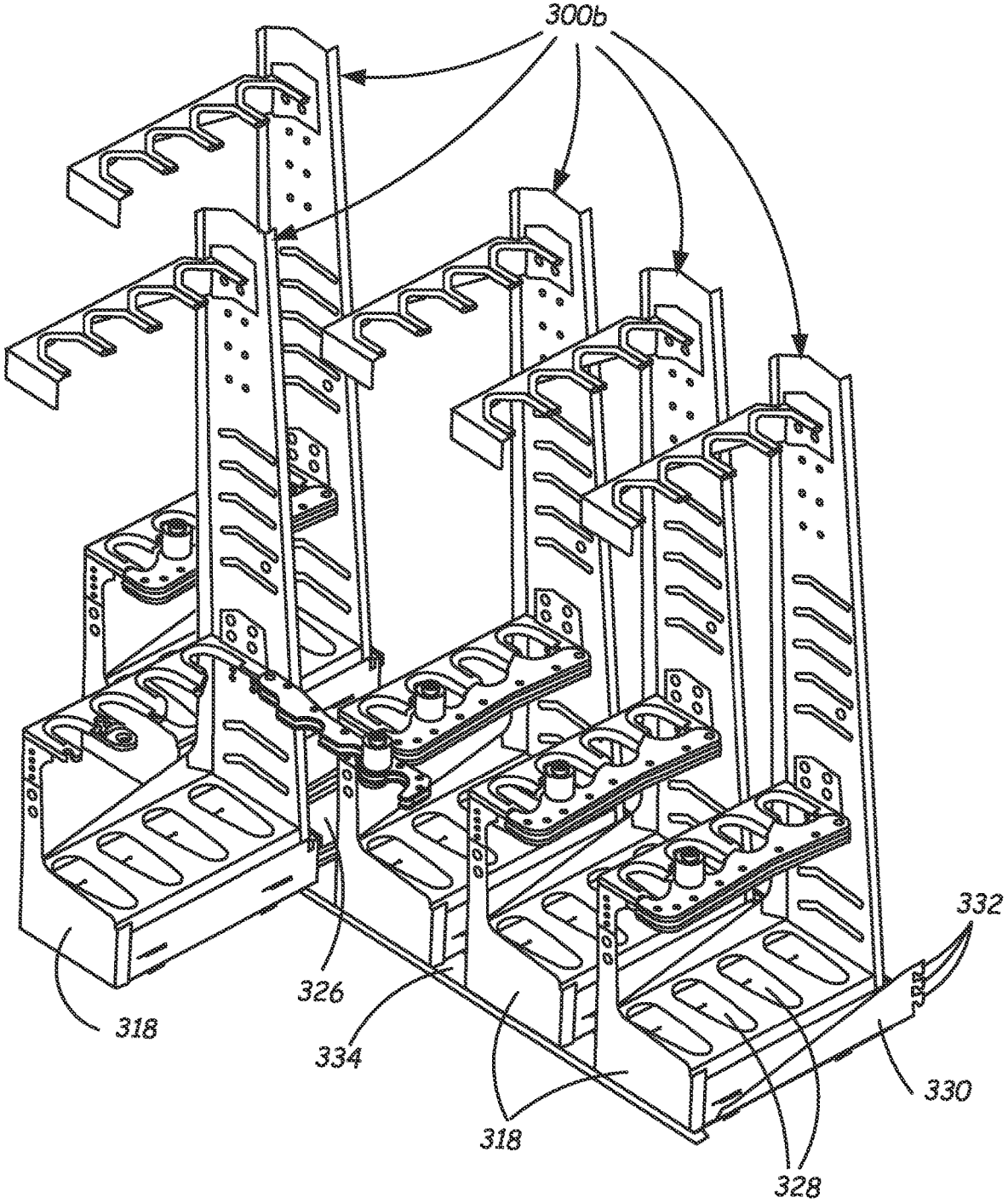
FIG. 14 is a perspective view of an array of a plurality of firearm holders of FIGS. 12 and 13.
Figure 15:
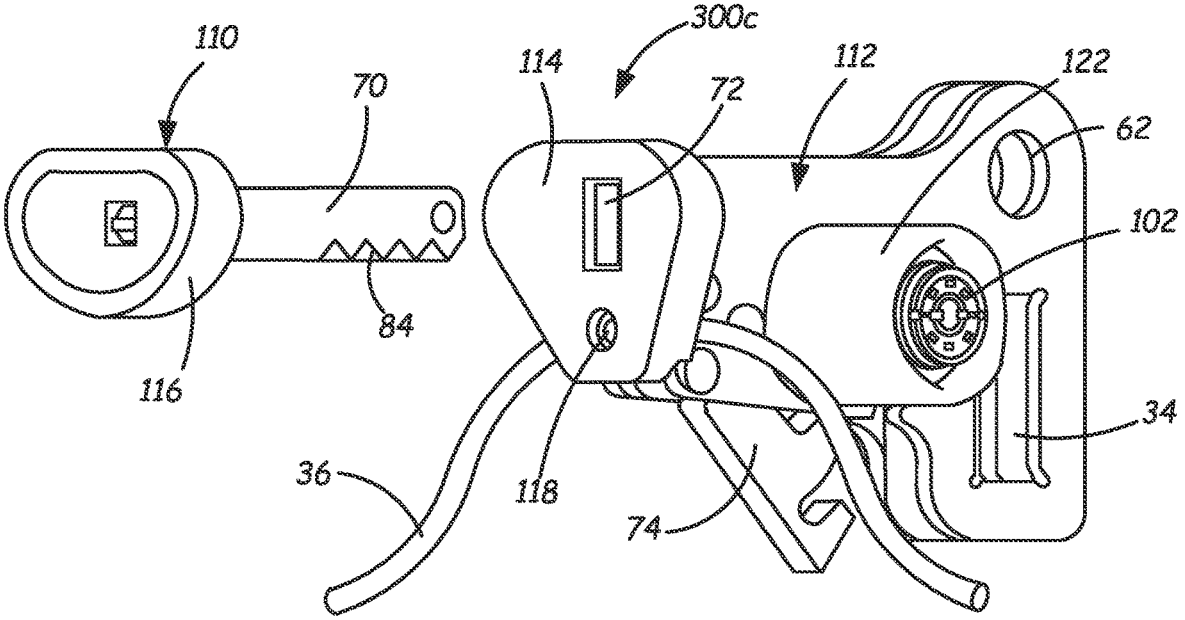
FIG. 15 is a right perspective view of a third exemplary firearm holder in an unlocked configuration, and with a firearm support wire.

In an exemplary embodiment as shown in FIGS. 12-14, firearm holder 300*b* is configured to secure firearms substantially vertically. An exemplary firearm holder 300*b* is a slidable rack, so that one firearm holder 300*b* can be moved from a set of a plurality of such firearm holders 300*b* to allow easy access to any particular firearm(s) 106 of interest. In exemplary embodiments, firearm holder 300*b* includes a frame 320 and a sliding base 318 coupled to a support 326 (see FIG. 14).

As shown in FIG. 12, the stock holder 120 is attached to frame 320 at a first location above the sliding base 318. The muzzle holder 104 is attached to frame 320 at a second location, typically higher than the first location. In exemplary embodiments, frame 320 includes a plurality of attachment holes 324 provided at different heights for selective attachment of muzzle holder 104. In exemplary embodiments, frame 320 includes a plurality of attachment holes 322 provided at different heights for selective attachment of stock holder 120. Attachment holes 322 and attachment holes 324 enable adjustment of the spacing between the muzzle holder 104 and the stock holder 120. In exemplary embodiments, sliding base 318 includes drawer slide mechanisms that enable the sliding base 318 to slide over support 326 (labeled in FIG. 14). Additional details are described in the following applications, which are hereby incorporated by reference: U.S. Patent Application Publication 2018/0160806 for "Display Device" and U.S. Patent Application Publication 2019/0313813 for "Slidable Rod Rack System."

An exemplary sliding base 318 includes a plurality of firearm butt rests 328, each one shaped as a depression corresponding to the recesses 316, 510, 511 in the muzzle holder 104 and stock holder 120, respectively. The depression 328 is configured to support a stock 105 of a firearm 106, as shown in FIG. 13, for example. Thus, the supported firearms 106 are prevented from sliding relative to the top surface of base 318. The drawer slide mechanisms of the cooperating base 318 and support 326 are provided under and within the base 318. As shown in FIG. 14, for example, such a configuration permits multiple firearm holders 300*b* to be arranged in close proximity to each other, without visible sliding mechanisms between the firearm holders 300*b*. In a configuration in which base 318 is slid over support 326, the base 318 provides a protective housing over the drawer slide mechanisms to protect them from dust, contamination and jostling such as by unintentional physical contact.

In an exemplary embodiment, tray 334, which holds several supports 326, includes mounting plate 330 which is oriented vertically. In an exemplary embodiment, fasteners 332 extend from a rear surface of mounting plate 330 to facilitate attachment of mounting plate 330 to a support structure such as vertical support 100, wall 130 or cabinet 108, as discussed above. Additional fasteners (not shown) can extend from a bottom of support 326 or tray 334 to facilitate attachment to a shelf or other support structure on which the firearm holder 300*b* is positioned. In exemplary embodiments, fasteners 332 and others may be configured as hooks, clips or other devices for attachment to a shelf, floor, or wall, for example.

FIGS. 12-14 show features that allow for the use of the cable assembly described with reference to FIGS. 1-5. As shown in FIG. 13 for example, in a method for securing the firearms 106 in firearm holder 300*b*, a small end 56 of cable 42 can be inserted through aperture 62 of frame 320, which is similar to aperture 62 of stock holder jaw 124 discussed above. Aperture 62 is sized so that the large end 58 of cable 42 cannot pass through aperture 62 and is therefore retained on a backside of frame 320, as shown in FIG. 13. The small end 56 of the cable 42 is passed through each of the apertures 50 of securing brackets 40, which have been inserted into shell ejection slots 60 and magazine wells 59 of the firearms 106. The cord 54 of the cable 42 is inserted into (and retained within) notch 64 of jaw 124 of stock holder 120, as described above. When the stock holder 120 is closed and locked, the cable assembly of securing brackets 40 and cable 42 offers another layer of security in locking the firearms 106 to firearm holder 300*b*.

FIGS. 15-24 show a third exemplary firearm holder 300*c*; FIGS. 16 and 20-23 show a firearm 106 locked therein. The firearm 106 is locked into the firearm holder 300*c* by a part of the holder 300*c* that is inserted through the firearm's trigger guard 103. Additionally, the firearm 106 is held in some cases by a support wire 36 attached to the firearm holder 300*c*. In an exemplary embodiment, the firearm holder 300*c* is mounted on rail 32 that is in turn attached to vertical support 100 on wall 130. Firearm holder 300*c* is configured to support firearms 106 horizontally. While not specifically illustrated, several such firearm holders 300*c* can be provided in a display.

In some exemplary embodiments, holder 300*c* includes an opening 34 sized to receive rail 32. In an exemplary embodiment, opening 34 has a height of 1 and 9/16 inches and a width of 13/16 inches. In an exemplary embodiment, rail 32 extends through opening 34 of holder 300*c*, which can slide onto and off of rail 32 for adjustable spacing between adjacent holders 300*c*. In the illustrated examples, the rail opening 34 has a substantially rectangular shape, which matches the profile of the rail 32 and which prevents rotation of the mounted firearm holder components relative to the rail 32. In an exemplary embodiment, rail 32 is a bar, rod, beam, or other rigid elongated element made of steel, carbon fiber, another metal or material or any combination thereof.

Figure 16:
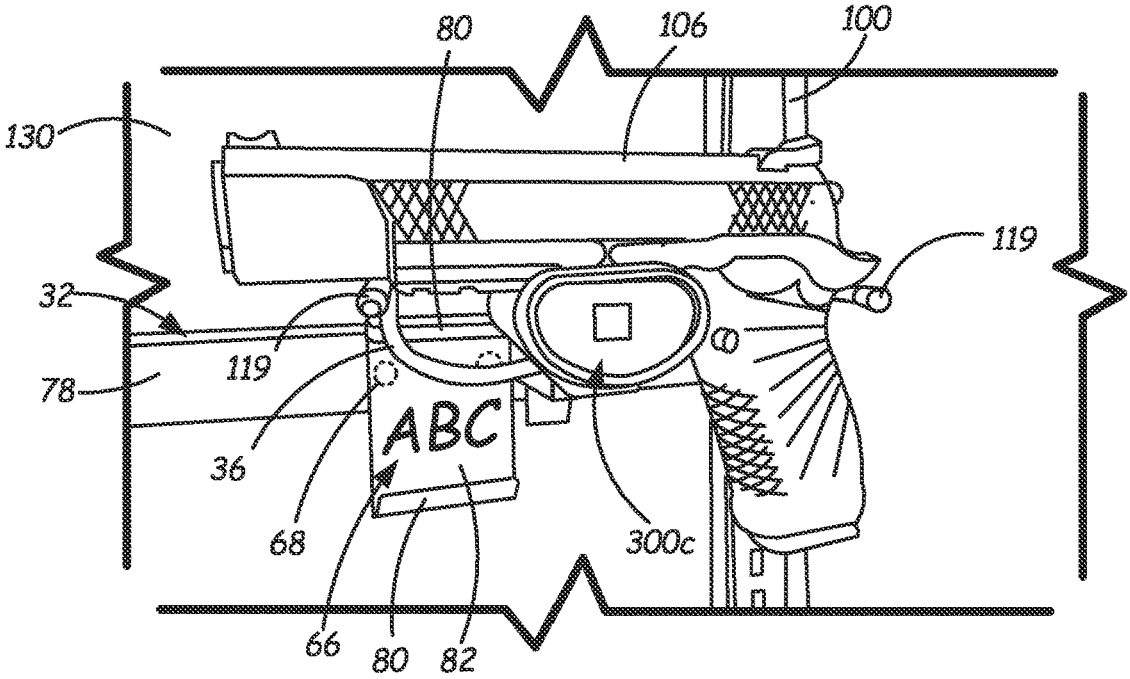
FIG. 16 is a front perspective view of the third exemplary firearm holder with a firearm held thereby.

If a user wishes to maintain the relative spacing and positions of holders 300*c* on rail 32, some embodiments have a rail positioning flange 66 (labeled in FIG. 16) proximate rail opening 34. As shown in FIG. 16, rail positioning flange 66 has apertures 68, each configured to accept a set screw or other fastener for engagement with a front surface 78 of rail 32. Thus, after a user has slid each holder 300*c* to a desired position on rail 32, the user can insert a fastener such as a set screw into the aperture 68 to fix the respective holder 300*c* to the rail 32 in the desired position. In exemplary embodiments, flange 66 is configured with upper and lower lips 80 so that the flange 66 can hold a display label 82 such as a price tag or other informational card, for example.

As shown in FIG. 16, an exemplary firearm holder 300*c* is configured for secure display of a firearm 106, though the firearm is not depicted in some drawings so that structures of the holder 300*c* are more clearly visible. In an exemplary embodiment, firearm holder 300*c* includes body 112 and trigger peg 110. Body 112 includes aperture 34 configured for mounting and sliding on rail 32. In an exemplary embodiment, body 112 includes an engagement flange 114 that is larger than a trigger assembly or trigger guard 103 on firearm 106 (labeled in FIGS. 3-5). The engagement flange 114 may be coated with rubber, silicon, or another material to prevent scratching of the surface of the firearm 106. The engagement flange 114 may contact the trigger guard 103 of the firearm 106 on a back side thereof.

Figure 22:
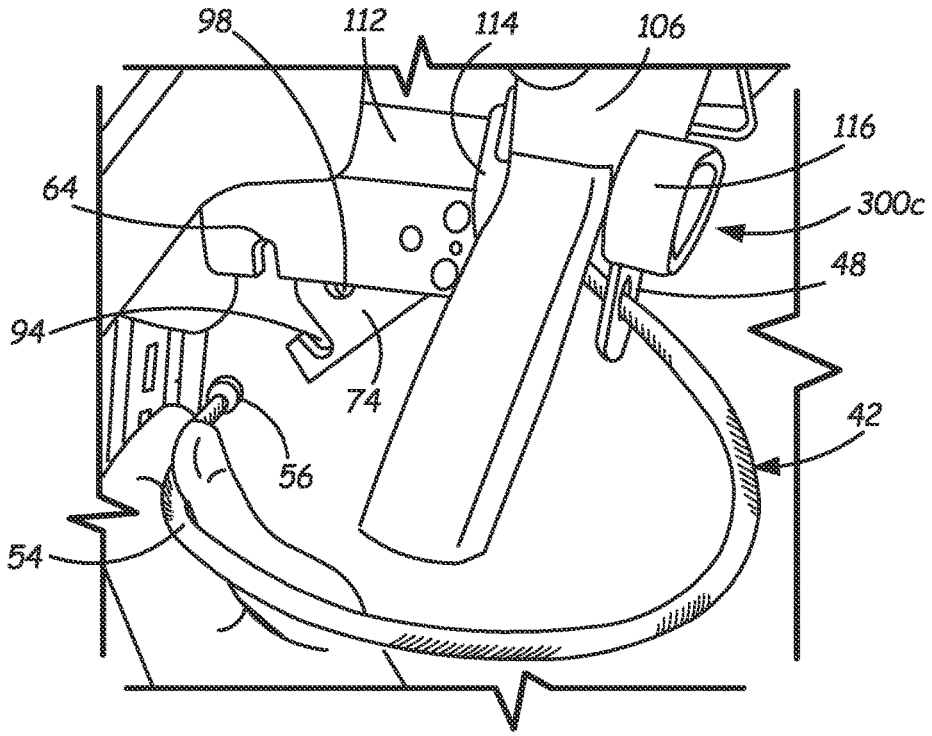
FIG. 22 is a partial perspective view showing the first end of the cable positioned for insertion into a notch of the locking plate of the third exemplary firearm holder.

In an exemplary embodiment, trigger peg 110 includes a trigger guard flange 116, which may be coated with a rubber, silicon, or another material to prevent scratching of the surface of the firearm 106. The trigger guard flange 116 may contact the trigger guard 103 of the firearm 106 on a front side of the firearm 106, as shown in FIG. 16. In an exemplary embodiment as shown in FIGS. 15 and 18A-19B, trigger peg 110 includes a toothed stem 70 that is configured for insertion through the trigger guard 103 of the firearm 106 and into opening 72 in body 112. Toothed stem 70 is configured for locking engagement with a complementarily toothed lock plate 74 (labeled in FIGS. 18A-19B) in body 112. The stem 70 and lock plate 74 are held in an engaged, locked configuration by lock 102, which in an exemplary embodiment is a plunger lock with plunger pin 142 configured to extend through pin aperture 98 of lock plate 74. As shown in FIG. 22, when the trigger peg 110 is secured to the body 112, the firearm 106 is secured between engagement flange 114 and trigger guard flange 116 and cannot be removed without unlocking the lock 102 using key 96.

Figure 17:
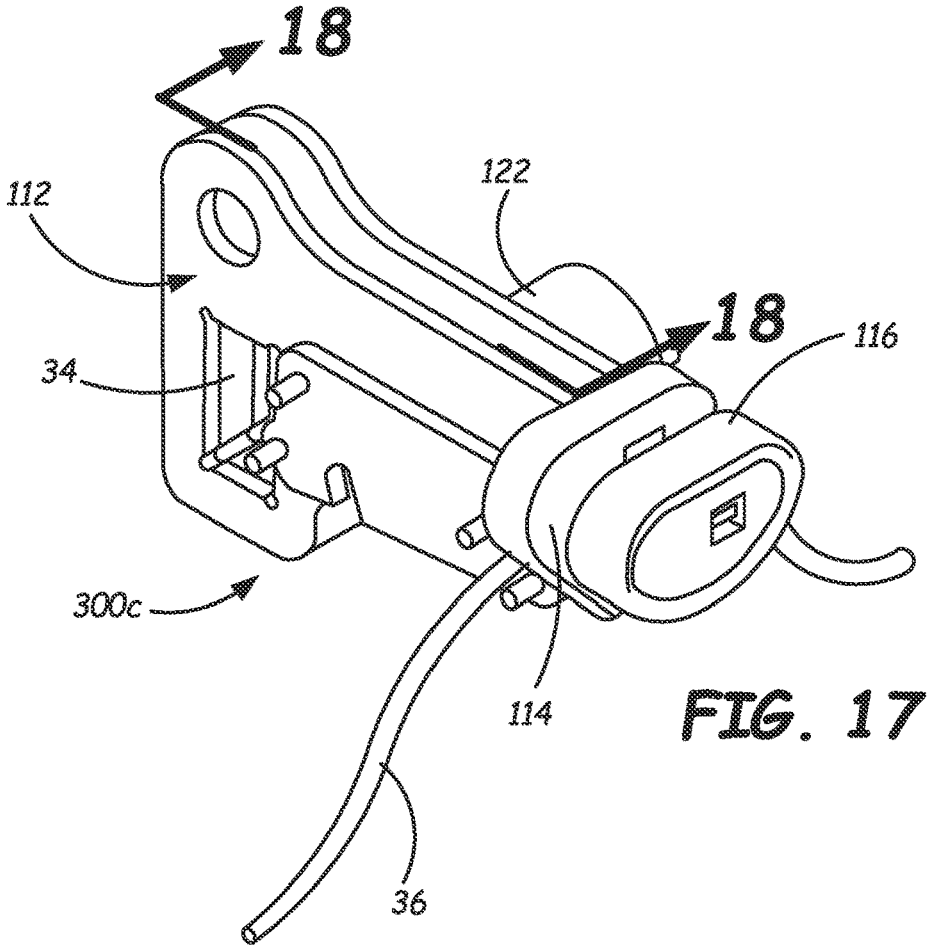
FIG. 17 is a left perspective view of the third exemplary firearm holder in a locked configuration.
Figure 24:
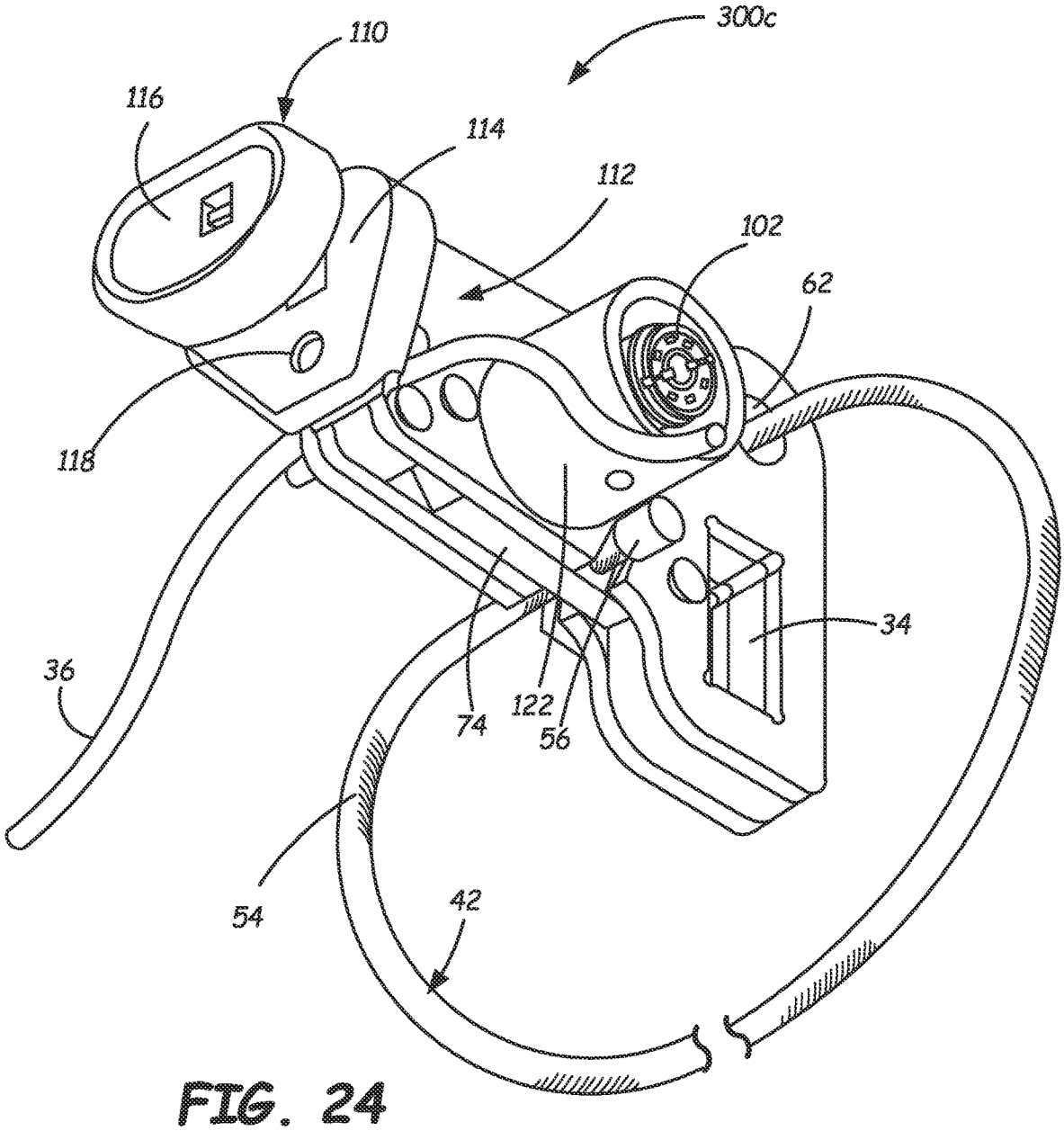
FIG. 24 is a right bottom perspective view of a locked third exemplary firearm holder with an inserted cable.

As shown in FIGS. 16 and 17 for example, a support wire 36 is inserted through aperture 92 (labeled in FIGS. 18B and 19B) in body 112 and can be secured in its aperture by a set screw or similar fastener (not shown) inserted through aperture 118 of engagement flange 114 (labeled in FIG. 24). In an exemplary embodiment, support wire 36 is a malleable yet strong repositionable wire that can be shaped in various curved configurations to serve as a support for the barrel and trigger handle of a firearm 106, as shown in FIG. 16. In an exemplary embodiment, support wire 36 is formed of a 0.85-foot-long segment of one-quarter inch diameter copper wire covered with a non-scratch polymer sleeve. Moreover, the support wire 36, as shown in FIG. 16, can be capped at both ends with rubber end caps 119 to maintain the non-scratch polymer sleeve over the copper wire. In some drawings, support wire 36 is depicted as hanging downward, so that it does not obscure other structures of the firearm holder 300*c*. However, it is expected that in use, a user will bend the support wire 36 to custom form a support structure for a firearm 106 to the size and shape and desired support orientation, as shown in FIG. 16, for example. Support wire 36 is an optional component and can be removed from firearm holder when its use with a particular firearm 106 is not desired.

In an exemplary embodiment, body 112 of firearm holder 300*c* includes a reinforcement cylinder 122 disposed around the lock 102. In an exemplary embodiment, reinforcement cylinder 122 is formed of steel or another rigid material to protect lock 102 from tampering, such as an attempt to break off lock 102.

Figure 18A:
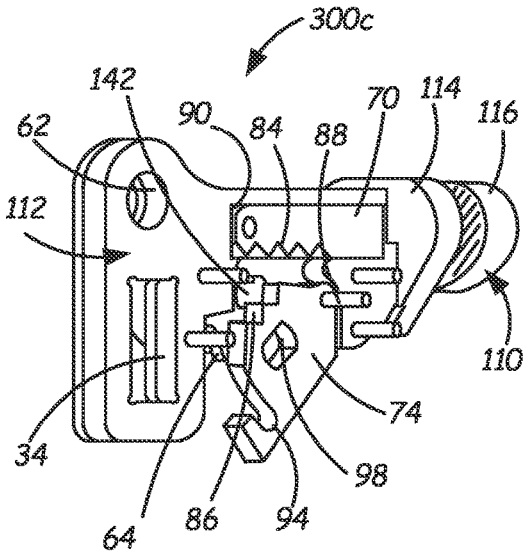
FIG. 18A is a partial interior view of the firearm holder in an unlocked configuration; a left plate of the body (along line 18-18 of FIG. 17) has been removed.
Figure 18B:
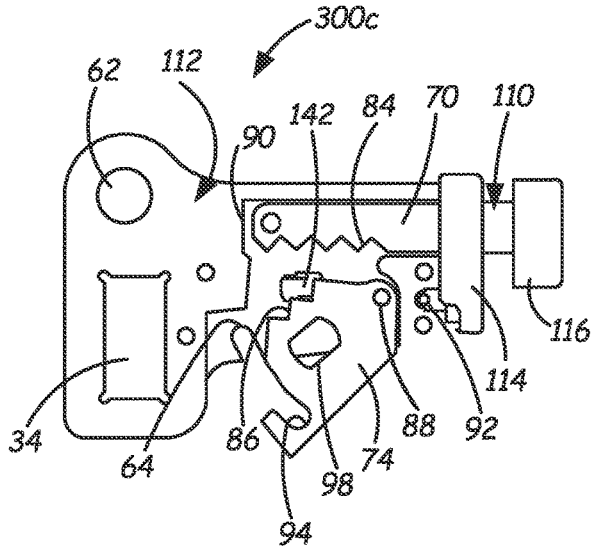
FIG. 18B is a side elevation view of the components of FIG. 18A.
Figure 19A:
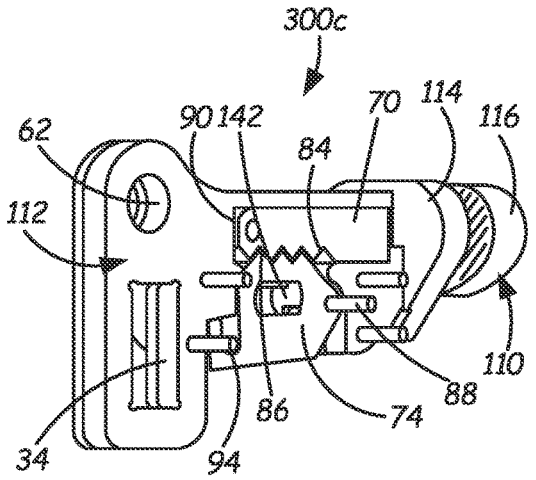
FIG. 19A is a partial interior view of the firearm holder in a locked configuration, as in FIG. 17; a left plate of the body (along line 18-18 of FIG. 17) has been removed.
Figure 19B:
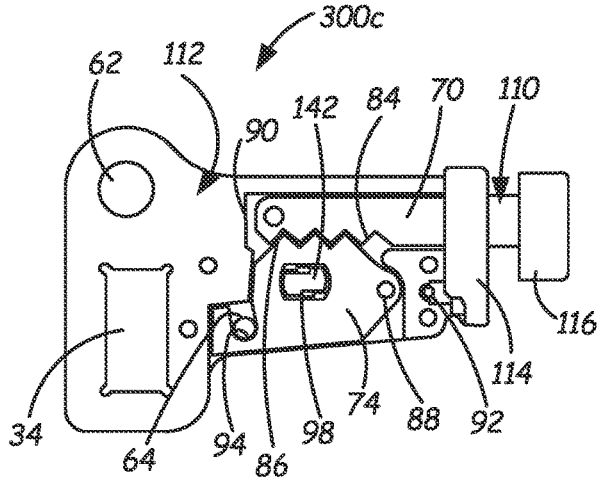
FIG. 19B is a side elevation view of the components of FIG. 19A.

FIGS. 18A-19B are partial interior views of the firearm holder 300*c*, as viewed at line 18-18 of FIG. 17. FIGS. 18A and 18B show the firearm holder 300*c* in an unlocked state and FIGS. 19A and 19B show the firearm holder 300*c* in a locked state. Stem 70 of trigger peg 110 in an exemplary embodiment includes a serrated edge 84 that is configured to securely mate with a corresponding serrated edge 86 of lock plate 74. As illustrated, the interlocking edges 84, 86 have complimentary teeth; however, other interlocking edge structures are suitable, such as projections and recesses; undulating waves, dentils, and barbs and notches, for example. In an exemplary embodiment, interlocking edges 84, 86 can mesh in various depth positions of stem 70 in channel 90. Thus, the spacing between engagement flange 114 and trigger lock flange 116 can vary to accommodate different thicknesses of firearms 106 at their trigger guards 103. FIGS. 18A-19B show stem 70 fully inserted into channel 90. However, if a wider gap is desired between engagement flange 114 and trigger lock flange 116, stem 70 can be inserted into channel 90 so that the teeth of edge 84 are indexed one tooth width to the right compared to the teeth of serrated edge 86.

To lock a firearm holder 300*c*, a user pivots lock plate 74 about pivot pin 88 so that the complimentarily serrated edges 84 and 86 mate, as shown in FIGS. 19A and 19B. Channel 90 in body 112 is dimensioned to closely fit the contours of stem 70 so that when the lock plate 74 is pivoted up as in FIGS. 19A and 19B, the trigger peg 110 cannot be pulled out of the body 112. Once the lock plate 74 is in the raised position shown in FIGS. 19A and 19B, a user takes key 96 (see FIG. 23) and inserts it into lock 102; manipulating or rotating the key 96 moves the plunger pin 142 of lock 102 to advance the pin into aperture 98 of lock plate 74 to thereby retain the lock plate in the raised position, wherein the trigger peg 110 is securely held by its stem 70 in the holder body 112. While particular structures of interlocking stem 70 and lock plate 74 are illustrated and described, it is contemplated that any interlocking structures could alternatively or additionally be used. For example, rather than complimentary serrated edges, the stem 70 and lock plate 74 could include complimentary ridges, notches, depressions, protrusions, or other mechanical locking structures.

Figure 20:
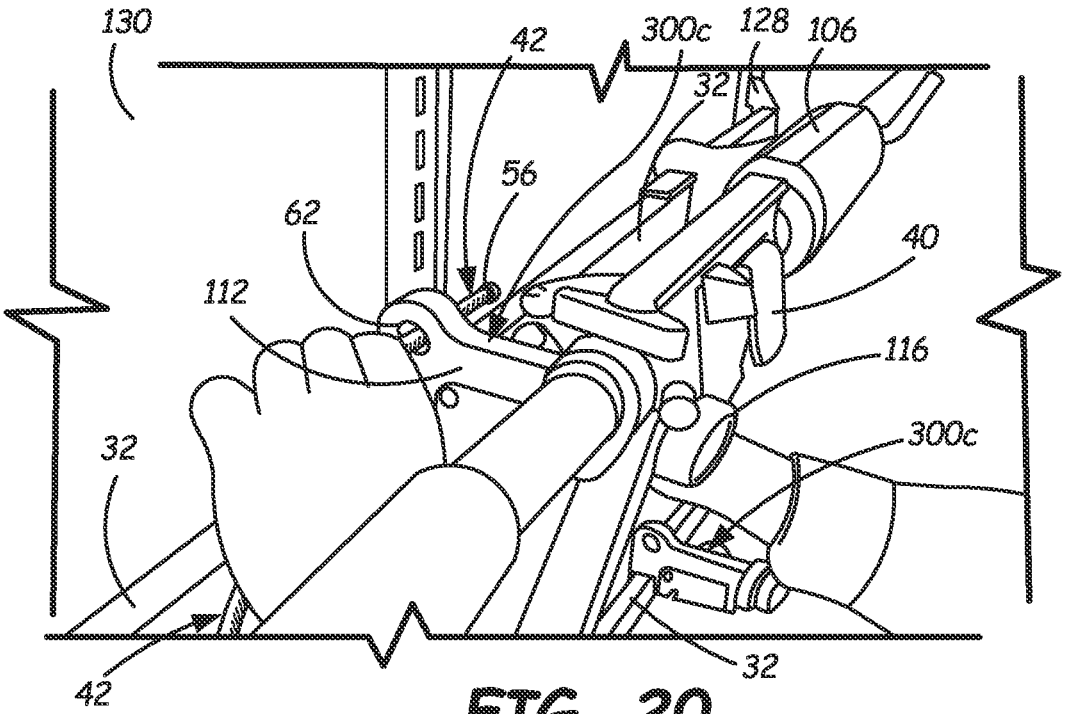
FIG. 20 is a partial perspective view showing the third exemplary firearm holder with a firearm; a first end of the cable is inserted through a holder aperture.
Figure 21:
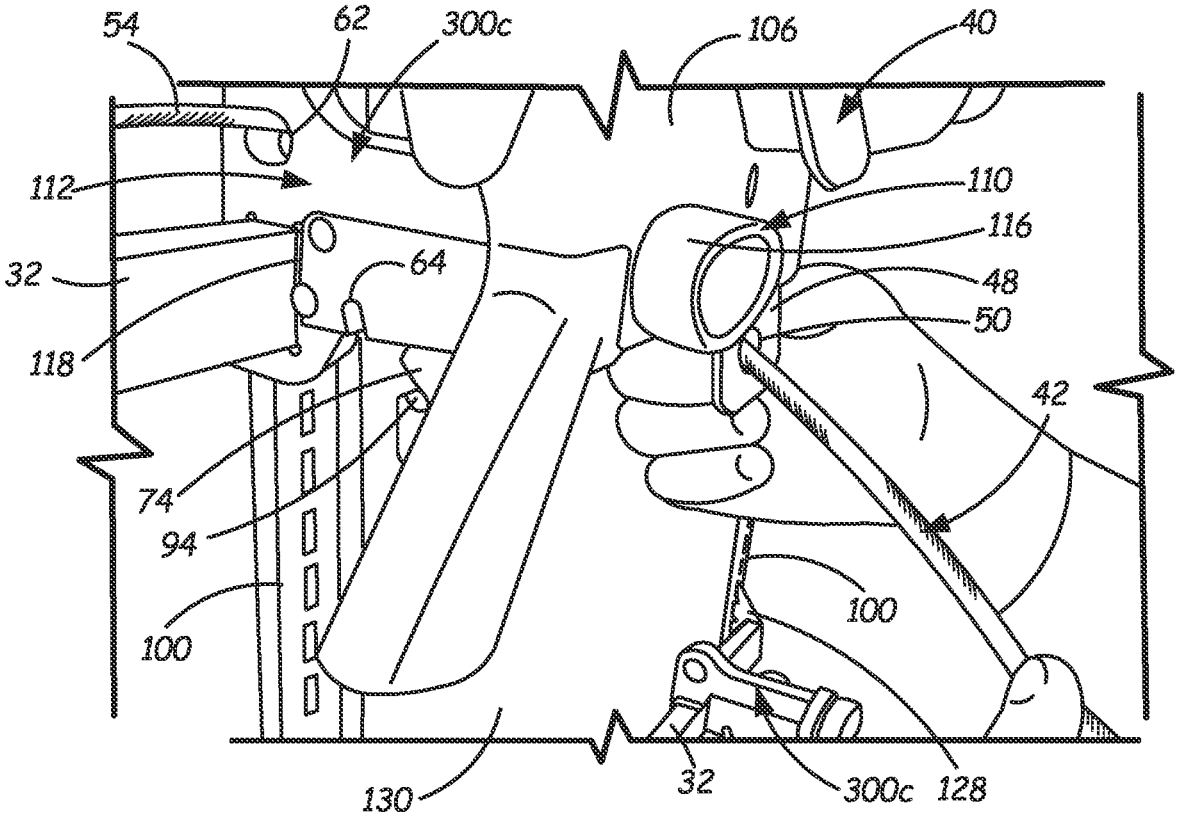
FIG. 21 is a partial perspective view showing insertion of the cable through the securing bracket that has been inserted into the shell ejection slot and the magazine well of the firearm.

In an exemplary embodiment, a firearm holder 300*c* includes aperture 62. In an exemplary embodiment, aperture 62 may be dimensioned similarly to aperture 50 of securing bracket 40, to thereby allow passage of small end 56 of cable 42 but restrict passage of large end 58 therethrough. As shown in FIG. 20, a user can pull cord 54 of cable 42 to the right direction as illustrated only to the extent that large diameter portion 58 contacts body 112 and is prevented from passing through aperture 62 because of the relatively larger size of large end 58. FIG. 21 shows that the small end 56 of cable 42 is then passed through the aperture 50 of securing bracket 40 which has been inserted into the shell ejection slot 60 and magazine well 59 of the firearm 106. FIG. 22 shows that the cord 54 is then inserted into notch 94 of lock plate 74. As shown in FIGS. 18B and 19B, notch 94 in lock plate 74 and cooperating notch 64 in holder body 112 are sized to allow insertion of cord 54 while preventing small end 56 from pulling through.

Figure 23:
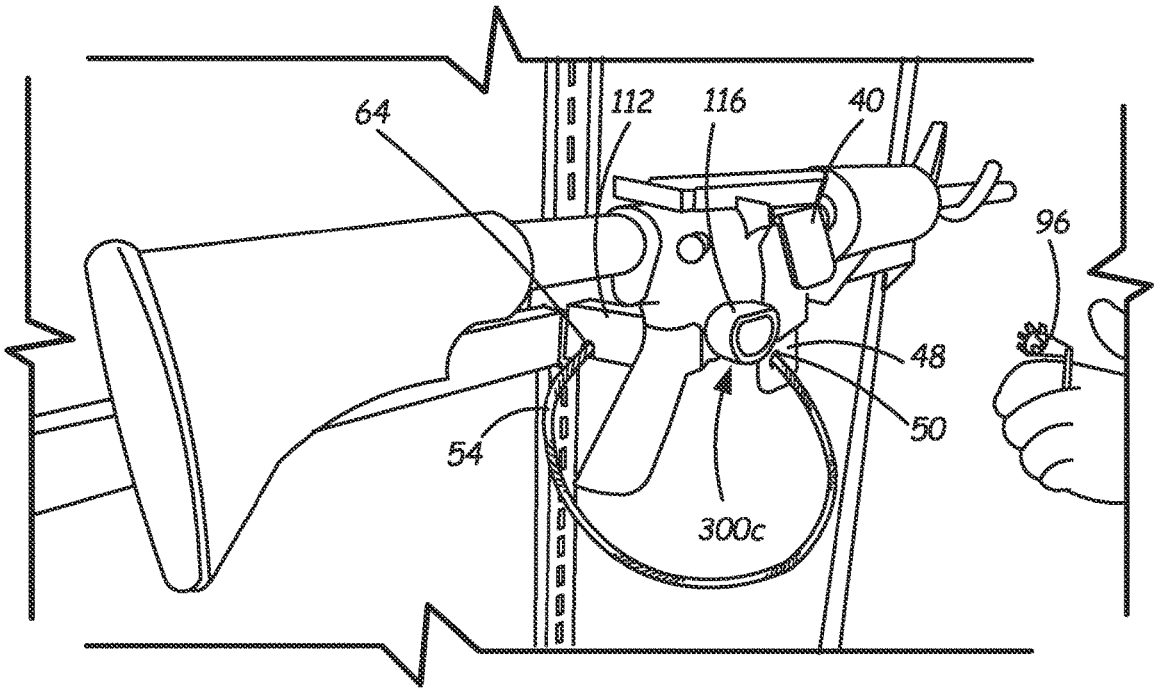
FIG. 23 is a perspective view of a firearm locked and secured in the third exemplary firearm holder with the cable assembly.

As shown in FIG. 23, a user then pivots lock plate 74 upward into body 112 to enclose cord 54 within an opening formed by the cooperating notches 64 and 94 (an opening smaller than the small end 56 of cable 42). With this action, the user also engages the cooperating serrated edges 84, 86—of toothed stem 70 and lock plate 74 respectively—internally within body 112. The user inserts and actuates key 96 in lock 102 to advance the plunger pin 142 of the lock into pin aperture 98 of lock plate 74. This locking retains cord 54 of cable assembly 42 in the enclosure defined by combined notches 64, 94 and also locks together the tooth connections of lock plate 74 and tooth stem 70, preventing removal of trigger peg 110 from body 112. A suitable lock with corresponding key is commercially available from Kenstan Lock Company of Plainview, New York under the model K2 Keymatic. However, any style of plunger lock can be used.

FIG. 24 is a bottom perspective view of an exemplary firearm holder 300*c* with support wire 36 and cable 42. The cable assembly of securing bracket 40 and cable 42, used with firearm holder 300*c*, redundantly locks the firearm 106 to the firearm holder 300*c* in a visually unobtrusive manner to provide security while allowing full view of the firearm 106.

FIGS. 25-28 show other configurations of firearm holders 300*d*, 300*e* for supporting firearms (not shown) in a vertical orientation. While particular embodiments of firearm holders 300 are illustrated, variations on such holders are contemplated, including changes in a number of firearms supported in each holder, and a number of holders provided in a display.

Each of firearm holders 300*a*, 300*b*, 300*d* and 300*e* includes stock holder 120 and muzzle holder 104. Moreover, particular configurations of muzzle holders 104 and stock holders 120 can be interchanged between the firearm holder embodiments to customize a particular firearm holder as desired. For example, the turret style firearm holder 300*d* of FIG. 25 could be modified to have closed muzzle holder cradle rings 316 as in the illustrated firearm holder 300*e* of FIGS. 27 and 28.

Figure 25:
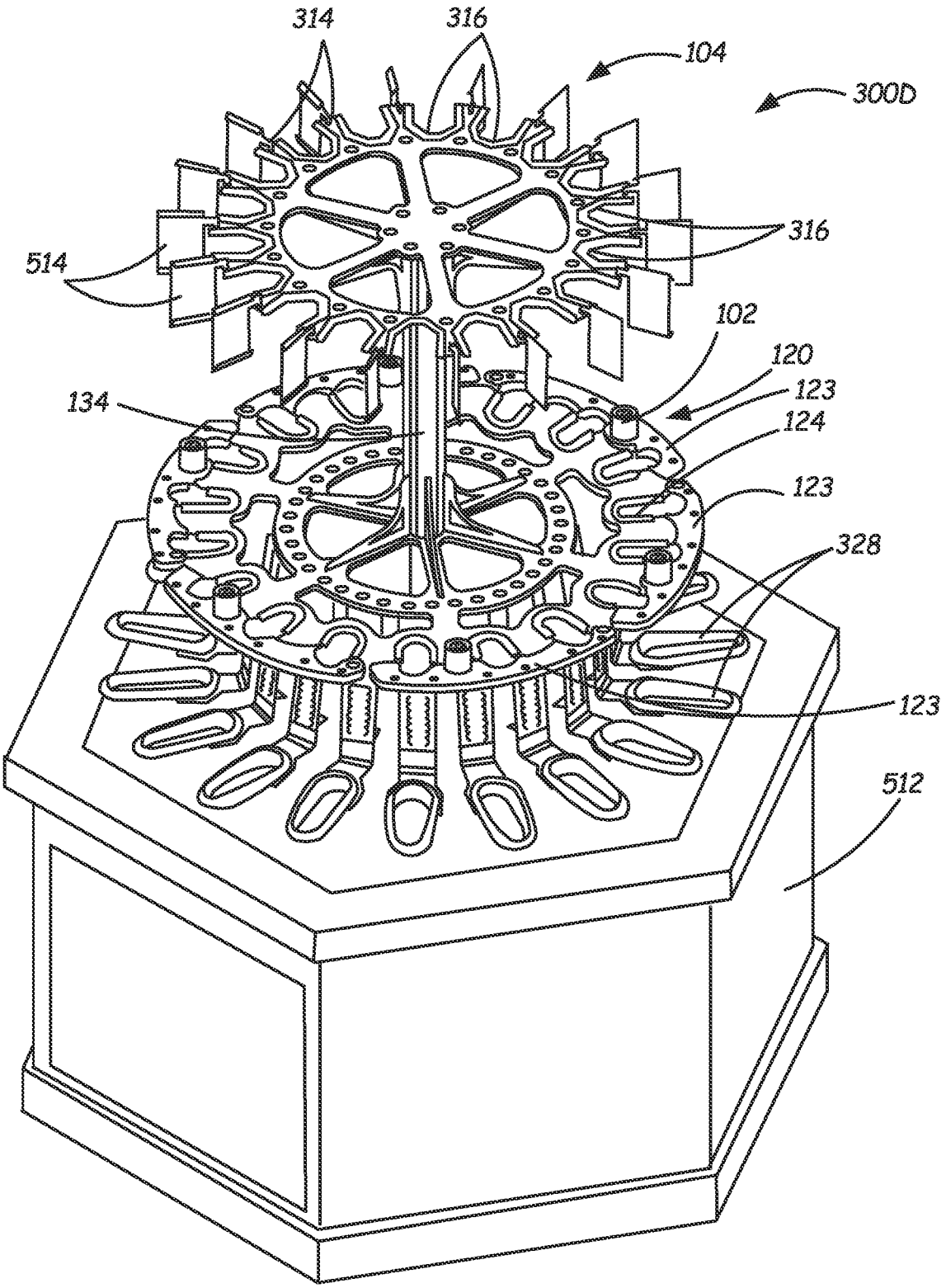
FIG. 25 is a perspective view of a fourth exemplary firearm holder configured for use with the described bracket and cable assembly.
Figure 26:
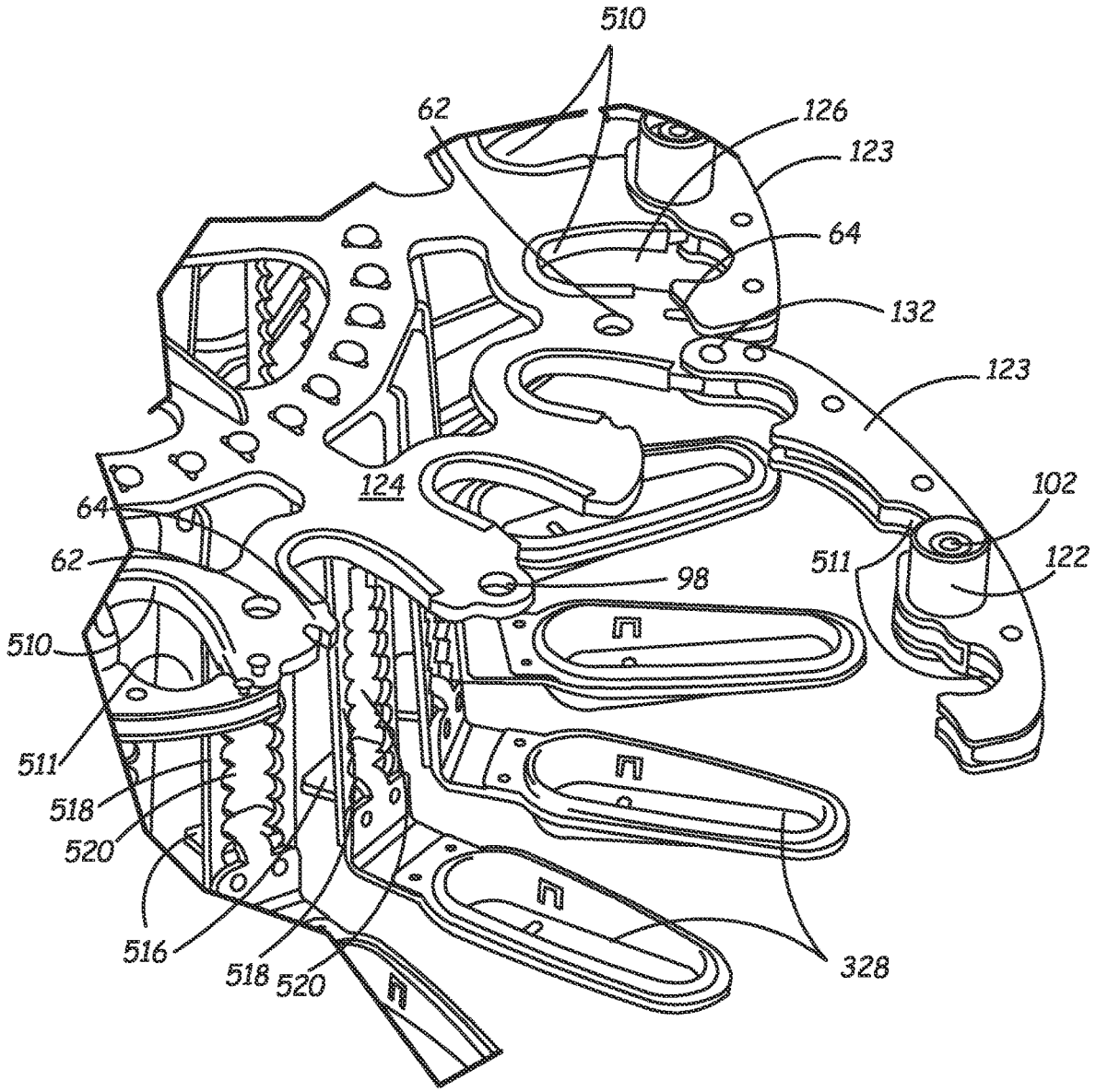
FIG. 26 is an enlarged partial perspective view of the fourth exemplary firearm holder with a stock holder in an open configuration.

FIGS. 25 and 26 show a fourth exemplary firearm holder 300*d*. As shown on FIG. 25, firearm holder 300*d* is placed in an exemplary embodiment upon a base 512 that is shaped generally as a hexagonal prism. Firearm holder 300*d* extends vertically upward from base 512 and has a generally circular configuration of stock holder 120 and muzzle holder 104. In many respects, the firearm holder elements are similar to those of other embodiments, and descriptions of elements with respect to one embodiment also apply to those elements in another embodiment, unless noted otherwise. In an exemplary embodiment, second jaws 124 comprising a plurality of recesses 510 for the receipt of a neck of a firearm 106 are arranged in a generally circular, horizontally disposed plate supported by shaft 134 and spaced from base 512. Multiple first jaws 123 are attached to the second jaw 124, so that unlocking a first jaw 123 from a corresponding second jaw 124 portion exposes only some of the plurality of firearms, while other still locked first jaws 123 secure additional firearms in holder 300*d*. In the illustrated embodiment, each first jaw 123 encloses three firearms in cooperation with second jaw 124; in an exemplary embodiment, the firearm holder 300*d* is capable of securing up to 18 firearms in associated enclosures 126.

In an exemplary embodiment, the butt or base of the stock 105 of a firearm 106 is receivable in butt rest 328, which is configured as a shallow, generally oval shaped cup. As shown in FIG. 26, for example, in an exemplary embodiment, each butt rest 328 has an attachment flange 516 adjustably receivable within rail 518 to provide for variable height positions of butt rest 328 with respect to base 512 and stock holder 120. Thus, the resting position of an individual firearm 106 can be adjusted so that its neck is securely received with an enclosure 126 of stock holder 120. In an exemplary embodiment, rail 518 includes notched aperture 520 defining a plurality of steps upon which flange 516 of butt rest 328 can selectively attach.

Referring to FIG. 25, while shaft 134 is fixedly attached to base 512 in some embodiments, in other configurations, the firearm holder 300*d* may rotate upon base 512. In an exemplary embodiment, muzzle holder 104 is positioned at a top end of shaft 134 and includes a plurality of cradles 316 for the receipt of muzzles 107 of firearms 106. In an exemplary embodiment, a tag holder 514 extends from each ridge 314 between adjacent cradles 316 and is configured to bear informational indicia thereon, such as a printed card with model and price information for the firearm held within the respective cradle 316. In some embodiments, tag holder 514 can have a similar structure as flange 66 of firearm holder 300*c*, with bottom and top lips to hold a card or other label.

Figure 27:
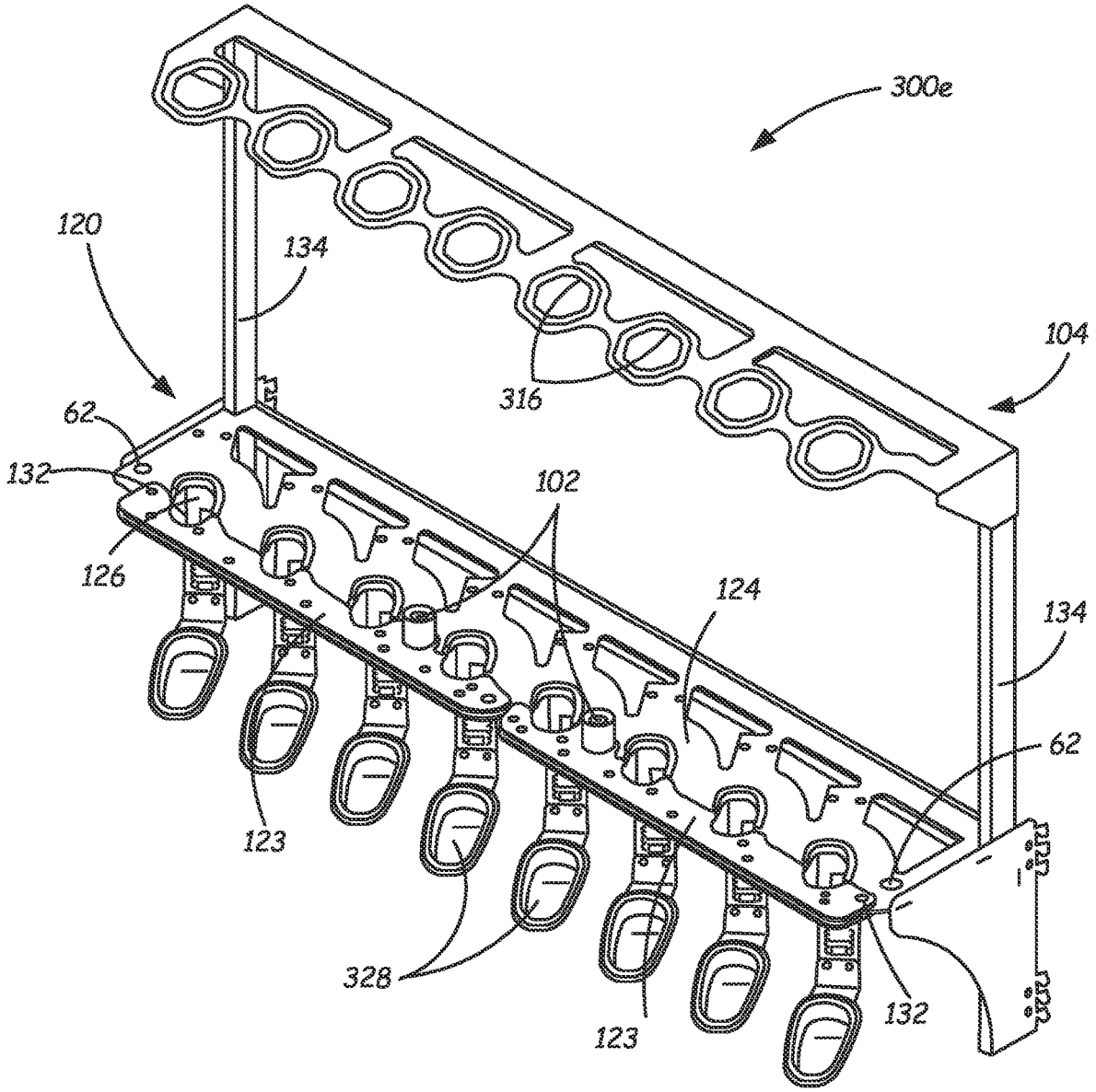
FIG. 27 is a perspective view of a fifth exemplary firearm holder configured for use with the described bracket and cable assembly.
Figure 28:
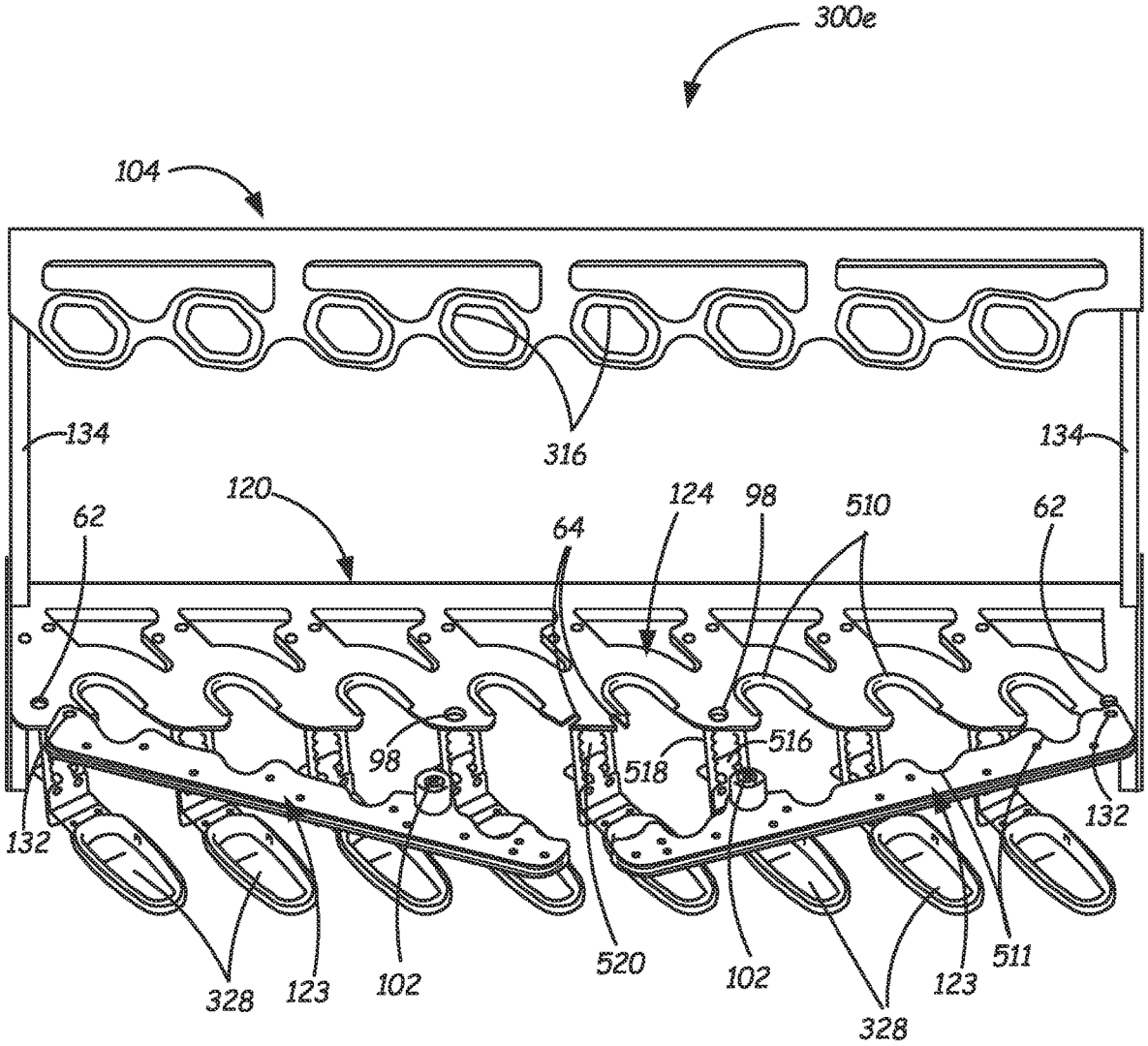
FIG. 28 is a front perspective view of open stock holders of the fifth exemplary firearm holder.

FIGS. 27 and 28 show a fifth exemplary firearm holder 300*e* configured for use with the described bracket and cable assembly. FIG. 27 shows closed stock holders 120, and FIG. 28 shows open stock holders 120. In an exemplary embodiment, second jaw 124 comprises a plurality of recesses 510 for the receipt of a neck of a firearm 106. Two first jaws 123 are attached to the second jaw 124, so that unlocking a first jaw 123 from a corresponding second jaw 124 portion exposes only some of the plurality of firearms, while the other still locked first jaw 123 secures additional firearms in holder 300*e*. In the illustrated embodiment, each first jaw 123 encloses four firearms in cooperation with second jaw 124; in an exemplary embodiment, the firearm holder 300*e* is capable of securing up to 8 firearms in associated enclosures 126.

In an exemplary embodiment, the butt or base of the stock 105 of a firearm 106 is receivable in butt rest 328, which is configured as a shallow, generally oval shaped cup. In an exemplary embodiment, each butt rest 328 has an attachment flange 516 adjustably receivable within rail 518 to provide for variable height positions of butt rest 328 with respect to stock holder 120. Thus, the resting position of an individual firearm 106 can be adjusted so that its neck is securely received with an enclosure 126 of stock holder 120. In an exemplary embodiment, rail 518 includes notched aperture 520 defining a plurality of steps upon which flange 516 of butt rest 328 can selectively attach. In an exemplary embodiment, muzzle holder 104 is positioned at a top end of shafts 134 and includes a plurality of cradles 316 for the receipt of muzzles 107 of firearms 106.

In any set of multiple stock holders 120, each of the stock holders 120 can be unlocked and open or locked and closed independently of any other stock holder 120 of the set. Additionally, the firearm holders 300 are depicted as holding the same types of firearms 106; however, the firearm holders 300 of a set or of a particular display may differ from one another, and portions of a firearm holder 300 and may be sized to hold different types and sizes of firearms 106, depending on the implementation. A plurality of firearm holders 300 can be placed on a rail 32. Moreover, a plurality of rails 32 can be positioned on a wall 130 (whether or not in a cabinet 108). Thus, a vertical display space can securely and visibly display any number of firearms 106.

The firearm holders 300 described above provide a number of advantages over conventional firearm displays. Each firearm holder includes a lock 102 to secure all firearms 106 positioned therein, preventing removal and preventing discharge of each such firearm 106. For long firearms, muzzle holders 104 provide a barrel rest, which is adjustable in distance from the stock holder 120 to accommodate a wide variation in long gun sizes. The lock 102 secures the firearm 106 to the firearm holder 300 without obscuring the firearm 106, allowing a consumer to view the firearm 106 in a retail environment or allowing an owner to display the firearm 106 in a cabinet or a gun safe. Moreover, adding the cable assembly of securing bracket 40 and cable 42 to the use of firearm holders 300 adds a second layer of security while enabling full view of the firearms.

Exemplary, non-limiting examples of an assembly and method are described. In an exemplary embodiment, an assembly is configured to secure a firearm 106 having a shell ejection slot 60, the assembly comprising a cable 42 and a bracket 40. The bracket 40 is configured for partial insertion into the shell ejection slot 60. The bracket 40 comprises a front plate 44 and a tail 46, 48. The tail is disposed at an acute angle θ relative to the front plate 44. The tail comprises a first aperture 50 configured for insertion of the cable 42.

In an exemplary embodiment, the tail comprises a first portion 46 and a second portion 48 disposed at an obtuse angle β relative to each other. In an exemplary embodiment, the first portion 46 is disposed between the front plate 44 and the second portion 48. In an exemplary embodiment, the first aperture 50 is disposed on the second portion 48. In an exemplary embodiment, the first aperture 50 comprises a hardened steel nut 52. In an exemplary embodiment, the front plate 44 and the tail 46, 48 have a common width.

In an exemplary embodiment, the cable 42 comprises a cord 54 having a cord diameter, a first end 56 having a first diameter that is greater than the cord diameter, and a second end 58 having a second diameter that is greater than the first diameter. In an exemplary embodiment, the assembly comprises a firearm holder 300 comprising a second aperture 62 sized to permit passage of the first end 56 and prevent passage of the second end 58.

In an exemplary embodiment, the firearm holder 300*a*, 300*b*, 300*d*, 300*e* comprises a stock holder 120 and a muzzle holder 104. In an exemplary embodiment, a distance between the stock holder 120 and the muzzle holder 104 is adjustable. In an exemplary embodiment, the stock holder 120 comprises a first jaw 124 and a second jaw 123. The first jaw 124 comprises a first plurality of recesses 510. The second jaw 123 is movable relative to the first jaw 124, and the second jaw 123 comprises a second plurality of recesses 511. The first and second jaws 124, 123 are configured to be locked together to form a plurality of enclosures 126 defined by cooperation of the first and second plurality of recesses 510, 511. In an exemplary embodiment, the second jaw 123 is movable relative to the first jaw 124 about at least two pivot axes 132, 310.

In an exemplary embodiment, the firearm holder 300 comprises a notch 64 sized to permit insertion of the cord 54 and prevent passage of the first end 56. In an exemplary embodiment, the firearm holder 300*b* comprises a sliding base 318. In an exemplary embodiment, the firearm holder 300*c* comprises a trigger peg 110 configured for insertion through a trigger guard 103 of the firearm 106 and into a trigger flange 114 of a body 112 of the firearm holder 300*c*.

In an exemplary embodiment, a method of securing a firearm 106 having a shell ejection slot 60 comprises inserting a tail 46, 48 of a bracket 40 into the shell ejection slot 60 so that a front plate 44 of the bracket 40 remains outside the shell ejection slot 60; inserting a first end 56 of a cable 42 through a first aperture 50 of the tail 46, 48; and retaining the first end 56 of the cable 42 in a notch 64 of a firearm holder 300.

In an exemplary embodiment, the method comprises locking a stock 105 of the firearm 106 in an enclosure 126 of the firearm holder 300. In an exemplary embodiment, the method comprises forming the enclosure 126 by closing first and second jaws 124, 123 of the firearm holder 300*a*, 300*b*, 300*d*, 300*e* around the stock 105. In an exemplary embodiment, the method comprising inserting a trigger peg 110 of the firearm holder 300*c* through a trigger guard 103 of the firearm 106. In an exemplary embodiment, the method comprises inserting the first end 56 of the cable 42 through a second aperture 62 of the firearm holder 300. In an exemplary embodiment, the method comprises retaining the second end 58 of the cable 42 to prevent its passage through the second aperture 62.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa. All references mentioned in this disclosure are hereby incorporated by reference, including pending U.S. patent application Ser. No. 17/311,658 for "Firearm holder including a stock lock and muzzle holder."

The invention claimed is:

1. An assembly configured to secure a firearm having a shell ejection slot, the assembly comprising:
- a cable; and
- a bracket configured for partial insertion into the shell ejection slot, the bracket comprising a front plate and a tail, wherein:
  - the front plate and the tail have a same width;
  - the tail is disposed at an acute angle relative to the front plate; and
  - the tail comprises a first aperture configured for insertion of the cable.

2. The assembly of claim 1 wherein:
- the tail comprises first and second portions disposed at an obtuse angle relative to each other; and
- the first portion is disposed between the front plate and the second portion.

3. The assembly of claim 2 wherein the first aperture is disposed on the second portion.

4. The assembly of claim 1 wherein the cable comprises:
- a cord having a cord diameter;
- a first end having a first diameter that is greater than the cord diameter; and
- a second end having a second diameter that is greater than the first diameter.

5. The assembly of claim 4 comprising a firearm holder comprising a second aperture sized to permit passage of the first end and prevent passage of the second end.

6. The assembly of claim 5 wherein the firearm holder comprises:
- a stock holder; and
- a muzzle holder.

7. The assembly of claim 6 wherein a distance between the stock holder and the muzzle holder is adjustable.

8. The assembly of claim 5 wherein the firearm holder comprises a notch sized to permit insertion of the cord and prevent passage of the first end.

9. The assembly of claim 5 wherein the firearm holder comprises a sliding base.

10. The assembly of claim 5 wherein the firearm holder comprises a trigger peg configured for insertion:
- through a trigger guard of the firearm; and
- into a trigger flange of a body of the firearm holder.

11. An assembly configured to secure a firearm having a shell ejection slot, the assembly comprising:
- a cable; and
- a bracket configured for partial insertion into the shell ejection slot, the bracket comprising a front plate and a tail, wherein:
  - the tail is disposed at an acute angle relative to the front plate; and
  - the tail comprises a first aperture that comprises a hardened nut and
  - is configured for insertion of the cable.

12. The assembly of claim 11 wherein:
- the tail comprises first and second portions disposed at an obtuse angle relative to each other; and
- the first portion is disposed between the front plate and the second portion.

13. The assembly of claim 12, wherein the first aperture is disposed on the second portion.

14. The assembly of claim 11, wherein the cable comprises:
- a cord having a cord diameter;
- a first end having a first diameter that is greater than the cord diameter; and
- a second end having a second diameter that is greater than the first diameter.

15. The assembly of claim 14, comprising a firearm holder comprising a second aperture sized to permit passage of the first end and prevent passage of the second end.

16. The assembly of claim 15, wherein the firearm holder comprises:
- a stock holder; and
- a muzzle holder.

17. The assembly of claim 15, wherein the firearm holder comprises a notch sized to permit insertion of the cord and prevent passage of the first end.

18. The assembly of claim 15, wherein the firearm holder comprises a sliding base.

19. An assembly configured to secure a firearm having a shell ejection slot, the assembly comprising:

a cable;

a bracket configured for partial insertion into the shell ejection slot, the bracket comprising a front plate and a tail, wherein:

the tail is disposed at an acute angle relative to the front plate; and the tail comprises a first aperture configured for insertion of the cable; and a stock holder comprising:

a second aperture sized to permit passage of a portion of the cable;

a first jaw comprising a first plurality of recesses; and a second jaw that is movable relative to the first jaw, wherein the second jaw comprises a second plurality of recesses;

wherein the first and second jaws are configured to be locked together to form a plurality of enclosures defined by cooperation of the first and second plurality of recesses.

20. The assembly of claim 19 wherein the second jaw is movable relative to the first jaw about at least two pivot axes.

* * * * *